United States Patent [19]

Asami et al.

[11] Patent Number: 4,554,775

[45] Date of Patent: Nov. 26, 1985

[54] METHOD OF FEEDING A SPECIFIC LENGTH OF WRAPPING PAPER FOR A COIN PACKAGING MACHINE AND DEVICE FOR CARRYING OUT SAID METHOD

[75] Inventors: Kazuto Asami; Takao Baba; Minoru Nakamura; Mitsuaki Tanaka, all of Himeji, Japan

[73] Assignee: Glory Kogyo Kabushiki Kaisha, Japan

[21] Appl. No.: 441,126

[22] Filed: Nov. 12, 1982

[30] Foreign Application Priority Data

Nov. 12, 1981 [JP] Japan ..... 56-181392

[51] Int. Cl.[4] ..... B65B 11/04

[52] U.S. Cl. ..... 53/64; 53/212; 53/389

[58] Field of Search ..... 53/66, 212, 64, 389

[56] References Cited

U.S. PATENT DOCUMENTS

| | | | |
|---|---|---|---|
| 2,994,997 | 8/1961 | Gwinn | 53/389 X |
| 3,045,403 | 7/1962 | Mitchell | 53/389 X |
| 3,899,864 | 8/1975 | Uchida | 53/212 |
| 4,047,364 | 9/1977 | Murakami | 53/212 X |
| 4,085,879 | 4/1978 | Nobrehiro | 53/212 X |
| 4,199,911 | 9/1980 | Miyazaki | 53/212 X |

*Primary Examiner*—John Sipos

*Attorney, Agent, or Firm*—Beveridge, De Grandi & Weilacher

[57] ABSTRACT

Improved method and device for feeding a specific length of wrapping paper to a packaging section in a coin packaging machine are disclosed, wherein the improvement consists in that every cycle of wrapping paper feeding is carried out by way of the steps of forwarding a certain length of wrapping paper to the packaging section by means of wrapping paper feeding rollers until the leading end part of the forwarded wrapping paper is brought to the position located at the side of one of wrapping rollers, firmly holding the wrapping paper against the guide wall of a guide passage, displacing a movable guide away from the latter, carrying out an additional feeding in dependence on the selected diameter of coins to be packaged and cutting off the wrapping paper to the specific length by thrusting it against a cutting knife while it is stretched.

18 Claims, 16 Drawing Figures

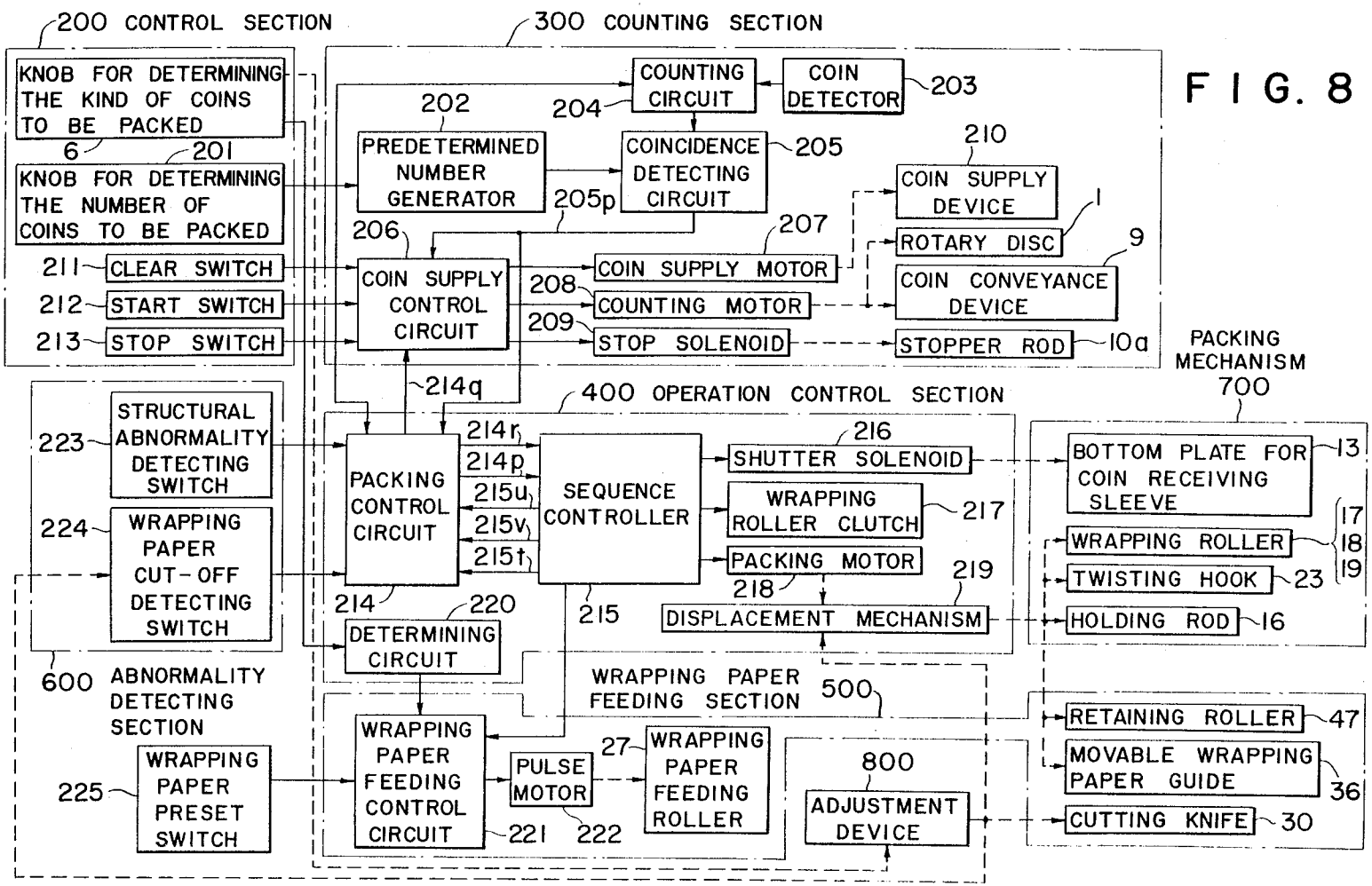
FIG. 8
300 COUNTING SECTION
COIN DETECTOR
203
COUNTING CIRCUIT
204
COINCIDENCE DETECTING CIRCUIT
205
PREDETERMINED NUMBER GENERATOR
202
205p
COIN SUPPLY DEVICE
210
ROTARY DISC
1
COIN CONVEYANCE DEVICE
9
STOPPER ROD
10a
COIN SUPPLY MOTOR
207
COUNTING MOTOR
208
STOP SOLENOID
209
COIN SUPPLY CONTROL CIRCUIT
206
214q
PACKING MECHANISM 700
BOTTOM PLATE FOR COIN RECEIVING SLEEVE
13
WRAPPING ROLLER
17
18
19
TWISTING HOOK
23
HOLDING ROD
16
RETAINING ROLLER
47
MOVABLE WRAPPING PAPER GUIDE
36
CUTTING KNIFE
30
400 OPERATION CONTROL SECTION
SHUTTER SOLENOID
216
WRAPPING ROLLER CLUTCH
217
PACKING MOTOR
218
DISPLACEMENT MECHANISM
219
SEQUENCE CONTROLLER
215
214r
214p
215u
215v
215t
PACKING CONTROL CIRCUIT
214
DETERMINING CIRCUIT
220
WRAPPING PAPER FEEDING SECTION 500
WRAPPING PAPER FEEDING ROLLER
27
PULSE MOTOR
222
WRAPPING PAPER FEEDING CONTROL CIRCUIT
221
800
ADJUSTMENT DEVICE
200 CONTROL SECTION
KNOB FOR DETERMINING THE KIND OF COINS TO BE PACKED
6
KNOB FOR DETERMINING THE NUMBER OF COINS TO BE PACKED
201
CLEAR SWITCH
211
START SWITCH
212
STOP SWITCH
213
600 ABNORMALITY DETECTING SECTION
STRUCTURAL ABNORMALITY DETECTING SWITCH
223
WRAPPING PAPER CUT-OFF DETECTING SWITCH
224
WRAPPING PAPER PRESET SWITCH
225

METHOD OF FEEDING A SPECIFIC LENGTH OF WRAPPING PAPER FOR A COIN PACKAGING MACHINE AND DEVICE FOR CARRYING OUT SAID METHOD

BACKGROUND OF THE INVENTION

The present invention relates to a method of feeding a specific length of wrapping paper to a packaging section in a coin packaging machine and a device for carrying out the method.

Hitherto known method and device for feeding a specific length of wrapping paper to a packaging section where a predetermined number of stacked coins are packaged with the wrapping paper are constructed such that a cycle of wrapping paper feeding operations are generally carried out by way of the steps of forwarding a strip of wrapping paper drawn out from a wrapping paper roll to the packaging section by means of a pair of wrapping paper feeding rollers along a guide wall of a wrapping paper guide passage, firmly holding the leading end part of the forwarded wrapping paper by pressure contact of a plurality of wrapping rollers with a stacked structure of coins which are caused to rotate by the latter so as to tightly stretch the wrapping paper between the wrapping paper feeding rollers and the wrapping rollers, cutting off it to the specific length by thrusting it against a cutting knife and allowing the specific length of wrapping paper to be wound round the stacked structure of coins.

In the conventional method and device the specific length of wrapping paper to be wound round the stacked structure of coins is determined by the length of the wrapping paper guide passage extending from the cutting knife and the packaging section.

In such a country as Japan where there is only an appreciable difference in diameter among plural kinds of current coins packaging operations are practiced without any particular difficulty even though a constant length is employed for all wrapping papers to be used. To the contrary, in other countries, for instance, England where there is a substantial difference in diameter among current coins it is necessary to make an adjustment with respect to a required length of wrapping paper in dependence on the diameter of coins to be packaged.

To fulfill the above necessity there were proposed various methods. One of them is such that the position where the cutting knife is mounted is displaced along the wrapping paper guide passage depending on the selected diameter of coins. Other one is such that the cutting knife is stationarily mounted but the guide wall of the wrapping paper guide passage is divided into two parts at a predetermined position one of which is adapted to be displaced from the initial position in dependence on the selected diameter of coins so as to change the working length of the wrapping paper guide passage. Another one is a combination of the above-described methods.

Due to the arrangement made for the conventional methods, complicated displacement or adjustment mechanisms such as mechanism for displacing the cutting knife in the direction of feeding of the wrapping paper, a mechanism for displacing one of a pair of wrapping paper guide walls to a directional position different from that of the other one and others are required. In case of the conventional method in which one of the pair of wrapping guide walls is displaced to a directional position different from that of the other one it is found that a smooth and continuous wrapping paper guide wall surface is formed only for a certain kind of coins to be packaged but an angularly bent point is formed at the junction between the pair of wrapping paper guide walls when packaging other kind of coins and thereby a smooth guide wall surface fails to be obtained, resulting in an occurrence of incorrect feeding of the leading end part of the wrapping paper.

Further, it is recognized with respect to countries in which no adjustment is required for the length of wrapping paper depending on the various kinds of coins to be packed that in a certain country a short length of wrapping paper is employed for packaging operations but in other country a very long length of wrapping paper is required. To meet the requirement it is necessary to design the wrapping paper guide passage in dimensions larger than that for the first mentioned country. This causes a working space required for the wrapping paper guide section in a coin packaging machine to become enlarged with the result that the coin packaging machine is constructed in a bigger size. This means that a single design for the coin packaging machine cannot be commonly employed for all countries in the world.

SUMMARY OF THE INVENTION

The present invention is intended to obviate the drawbacks pointed out with respect to the conventional coin packaging machine.

Hence, it is an object of the present invention to provide an improved method of feeding a specific length of wrapping paper to a packaging section in a coin packaging machine with such a flexibility that an additional feeding is effected in the optimum manner in dependence on the diameter of coins to be packaged or the country where the coin packaging machine is sued as well as a device for carrying out said method.

The improvement of the invention consists in that a wrapping paper guide passage extending from a pair of wrapping paper feeding rollers to a coin packaging section functions as a guide wall for forwarding a certain length of wrapping paper in the optimum manner until the leading end part thereof is brought to the packaging section and when a required length of the wrapping paper is longer than the whole length of the wrapping paper guide passage, at least a part of the latter is displaced away from the initial position so as to effect an additional feeding into the enlarged wrapping paper guide space.

Basically, a cycle of wrapping paper feeding operations are carried out by way of the steps of forwarding a normal length of wrapping paper to the packaging section by means of the pair of wrapping paper feeding rollers until the leading end part of the forwarded wrapping paper is brought to the position located by the side of one of wrapping rollers, firmly holding the forwarded wrapping paper against the guide wall of the wrapping paper guide passage at a predetermined position by means of a wrapping paper retaining mechanism, displacing a movable part of the wrapping paper guide passage away from the initial position, carrying out an additional feeding generally in dependence on the selected diameter of coins to be packaged, cutting off the wrapping paper to the required length by thrusting it against a cutting knife while it is stretched between the wrapping paper feeding rollers and the wrapping rollers and allowing the required length of wrapping paper to be wound round a stacked structure of coins.

Generally, one of the wrapping paper feeding rollers functions as a driving roller and the other one does as a follower roller. Preferably, a movable wrapping paper guide constituting a part of the wrapping paper guide passage is displaced away from the initial position by turning about an upright standing support shaft on the base plate of the coin packing machine, when an additional feeding is required. Usually, in case of a group of small size of diameter of coins to be packaged the movable wrapping paper guide does not carry out any turning movement, in case of a group of medium size of diameter of coins it is turned to an intermediate extent and in case of a group of large size of diameter of coins it is turned to the outermost position.

Typically, the leading end part of the forwarded wrapping paper is firmly held by displacing the wrapping rollers from the outermost inoperative position to the innermost operative position where they come in pressure contact with the outer cylindrical surface of the stacked structure of coins. Alternatively, it may be firmly held by means of a combination of a wrapping paper retaining and one of the wrapping rollers. When it is brought to the position by the wrapping roller, the wrapping paper retaining roller is displaced from the inoperative position to the operative position until it is brought in pressure contact with the stationary wrapping roller. Alternatively, it may be firmly held by means of a pair of wrapping paper retaining rollers, one of them being a stationary roller and the other one being adapted to be displaced from the inoperative position to the operative position where it comes in contact with the stationary roller.

When the wrapping paper is cut off to a required length, it is generally cut in the V-shaped configuration using the cutting knife having V-shaped cutting edges. The cutting knife includes a leaf spring and a cut-off detecting means both of which have a similar configuration to that of the cutting knife. The leaf spring serves to urge the residual part of the wrapping paper toward the guide wall of the wrapping paper guide passage, whereas the cut-off detecting means is in electrical connection with an operation control section.

When a wrapping paper roll becomes empty or it is to be exchanged with another one having a different width, one of the wrapping paper feeding rollers is preferably displaced away from the operative position so that the residual part of wrapping paper is drawn back or rewound.

In this connection it should be noted that an important thing is that the wrapping rollers and/or the wrapping paper retaining rollers are in operative association with the wrapping paper feeding rollers in such a manner that the latter are caused to stop their rotation when the leading end part of the forwarded wrapping paper becomes firmly held.

In a modified embodiment of the invention the wrapping paper feeding device of the invention is divided into a replaceable part and a stationary part. The replaceable part is constructed in the form of a wrapping paper storing section carrying a wrapping paper roll thereon of which width is dimensioned in dependence on the kind and/or number of coins to be stacked. Thus, a plurality of wrapping paper storing sections are prepared corresponding to the plural kinds and/or numbers of coins to be packaged. Each of the wrapping paper storing sections comprises a movable frame in the form of a shelf plate adapted to be turned about a pivotal shaft, a removable holding means in the form of a base plate extending in the radial direction relative to the pivotal shaft on which the wrapping paper roll is rotatably carried and a first stationary wrapping paper guide passage fixedly mounted on the removable holding means in such a manner as to form a continuous wrapping paper guide passage to the stationary side of the coin packaging machine. A second wrapping paper guide passage including a movable wrapping paper guide is disposed at the stationary side of the coin packaging machine and forms a continuation from the first wrapping paper guide passage. The cutting knife is disposed also in the stationary side of the coin packaging machine.

With respect to the pair of wrapping paper feeding rollers one of them is rotatably disposed on the wrapping paper storing section and the other one is rotatably disposed at the stationary side of the machine.

After a new wrapping paper roll is equipped on the base plate, the wrapping paper storing section is turned about the pivotal shaft until a correct position relative to the base plate at the stationary side of the machine is reached.

When the wrapping paper roll is to be exchanged with another one having a different width, one of the wrapping paper feeding rollers functioning as a driving roller is displaced outward of the wrapping paper storing section toward its inoperative position so that the residual length of wrapping paper is rewound and the wrapping paper storing section is exchanged with a new one without any interference between both the replaceable part and the stationary part of the machine.

In another modified embodiment of the invention the wrapping paper feeding device includes also a plurality of wrapping paper storing sections each of which comprises a movable frame adapted to be turned about a pivotal shaft, a removable holding means on which a wrapping paper roll is rotatably mounted and a combination of a first movable wrapping paper guide and a movable cutting knife both of which are turnably disposed on the removable holding means and fixedly secured to one another by way of a connecting member bridged therebetween. A second stationary wrapping paper guide is fixedly mounted on the base plate at the stationary side of the machine so as to form a continuous wrapping paper passage from the first one.

When an additional feeding of the wrapping paper is carried out or the wrapping paper storing section is exchanged with a new one, the combination of the first movable wrapping paper guide and the movable cutting knife is turned about an upright standing support shaft. In the latter case the aforesaid combination is displaced completely away from the base plate at the stationary side of the machine so that no interference takes place between both the replaceable part and the stationary part of the device, while one of the wrapping paper feeding rollers functioning as a driving roller is displaced to the inoperative position.

An operation control section is provided for correctly controlling, a number of operations of the wrapping paper feeding rollers, the movable wrapping paper guide, the wrapping paper retaining mechanism and the wrapping rollers in conformance with such a predetermined time sequence that a cycle of wrapping paper feeding operations are carried out in the optimum manner.

The nature, utility, and further features of this invention will be more clearly apparent from the following detailed description with respect to a preferred embodiment of the invention when read in conjunction with the accompanying drawings.

BRIEF DESCRIPTION OF THE DRAWINGS

The accompanying drawings will be briefly described below, in which:

FIGS. 1 to 3 illustrate a wrapping paper feeding device in accordance with the first embodiment of the invention;

FIG. 2 is a schematic plan view of the wrapping paper feeding device in FIG. 1(A), illustrating the arrangement of the device with a movable wrapping paper guide kept closed;

FIG. 3 is another schematic plan view of the wrapping paper feeding device in FIG. 1(A), illustrating the arrangement of the device with the movable wrapping paper guide kept opened;

FIGS. 4 to 7 illustrate a wrapping paper feeding device in accordance with another embodiments of the invention;

FIG. 4 is a schematic plan view of the wrapping paper feeding device in accordance with the second embodiment of the invention;

FIG. 5 is a schematic plan view of the wrapping paper feeding device in accordance with the third embodiment of the invention;

FIG. 8 is a block diagram of electrical control section with respect to the first embodiment.

DETAILED DESCRIPTION OF THE EMBODIMENTS

Figure 1A:
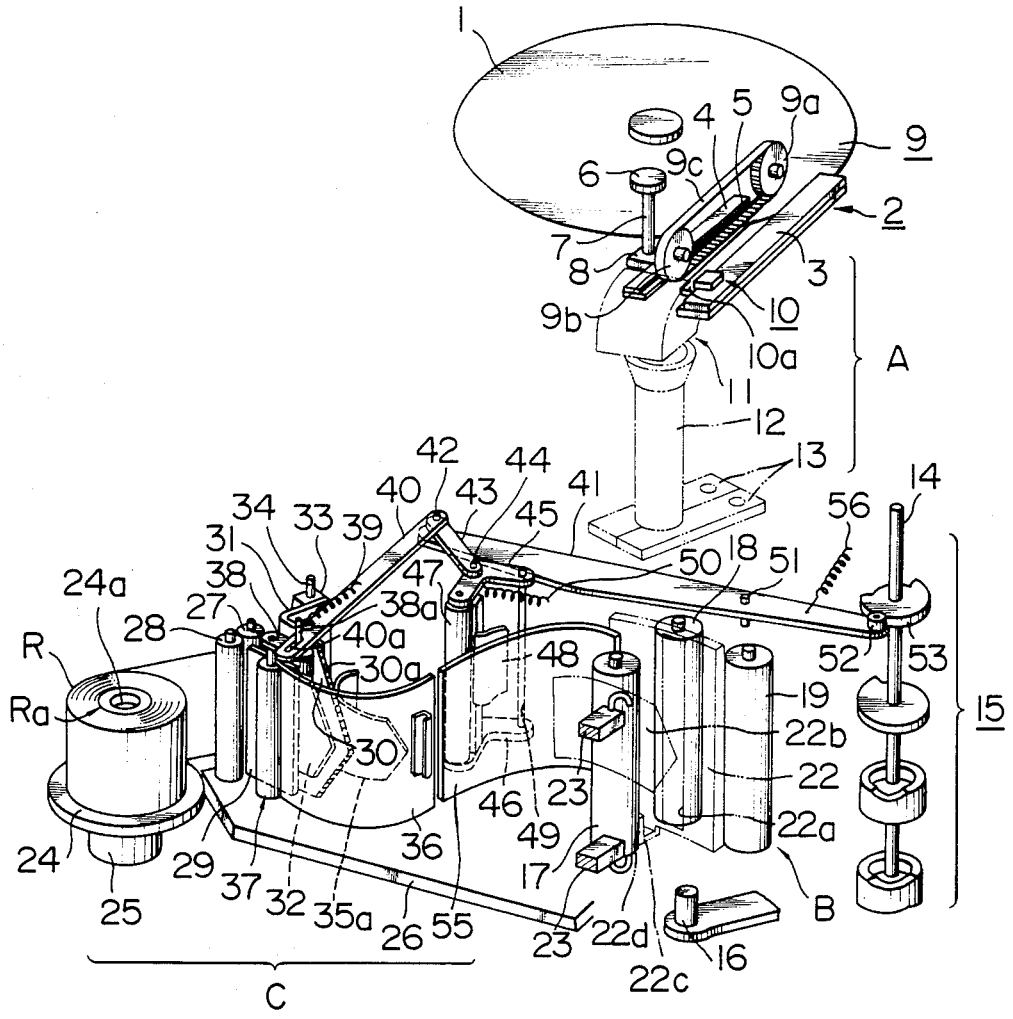
FIG. 1(A) is a perspective view of the whole wrapping paper feeding device.
Figure 1B:
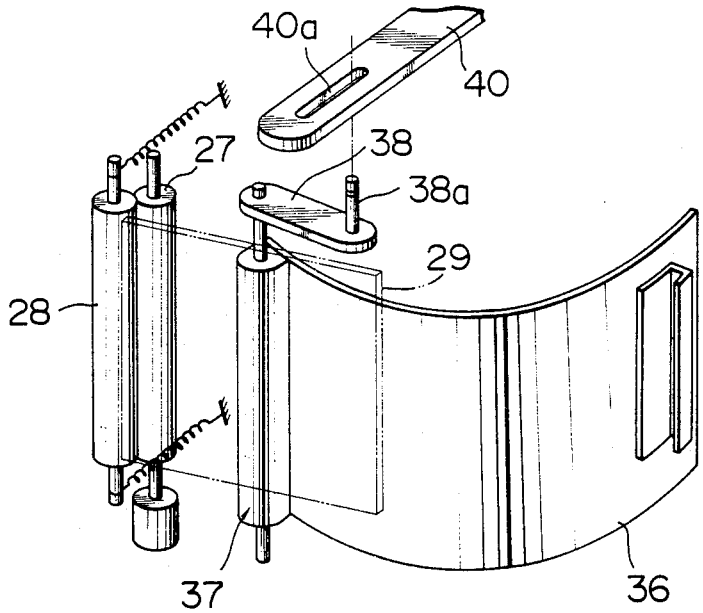
FIG. 1(B) is a perspective view of a movable wrapping paper guide and its associated members, shown in a disassembled state.

FIG. 1(A) illustrates the interior structure of a coin packaging machine by way of a perspective view to which the present invention is applied. A coin feeding section (A) and a coin packaging section (B) in the coin packaging machine both of which are constructed in the conventional manner will be first described.

The coin feeding section (A) is constructed such that coins to be packaged are supplied one by one onto a rotary disc 1 from a coin supply device which is not shown in the drawing, move along the circular peripheral wall (not shown) of the rotary disc 1 under centrifugal force caused by rotation of the latter while assuming a horizontal posture and then reach a coin passage 2 located at a certain position on the peripheral wall of the rotary disc 1 and extending therefrom in the outward direction. In the proximity of the inlet of the coin passage 2 is disposed a coin thickness defining member (not shown) which is located above the rotary disc 1 so as to inhibit an entrance of overlapped coins but permit only a single coin to pass therethrough.

The coin passage 2 includes a stationary passage wall member 3 defining the one side of the passage and a movable passage wall member 4 defining the other side of the same. Further, the coin passage 2 includes a longitudinally extending groove 5 located between said wall members 3 and 4 in which coins having a smaller diameter than that of the coins to be packaged are received and removed therefrom later. The movable passage wall member 4 is adapted to move in the transverse direction relative to the coin passage 2 by actuating an adjustment cam 8 fixedly fitted onto a shaft 7 including a knob 6 at the top end thereof so that the working inner width of the coin passage 2 is determined in dependence on the diameter of the coins to be packaged.

Above the coin passage 2 is disposed a coin conveyance device 9 which comprises an endless belt **9*c* extending around two pulleys 9*a* and 9*b* located at both the fore and rear parts of the coin passage 2. The endless pulley 9*c* is correctly held so as to convey the coins toward the outlet of the coin passage 2 one after another while coming in frictional contact with the upper surface of each of the coins. Other smaller coins are removed from the groove 5 while normal coins are conveyed by means of the endless belt 9*c***.

A counting device 10 is disposed at the extreme end part of the coin passage 2. The counting device 10 is designed in a conventional type including a coin detector in the form of a proximity switch (as identified with reference numeral 203 in FIG. 8) by means of which any passing of a coin is detected. After a predetermined number of coins are counted, a stopper rod **10*a* is actuated by means of a solenoid (as identified with reference numeral 209 in FIG. 8) whereby the next line of coins are inhibited from further conveyance and at the same time interruption of coin supply, interruption of coin feeding from the coin supply device (as identified with reference numeral 210 in FIG. 8) onto the rotary disc 1 and stoppage of operation of the rotary disc 1 and the coin conveyance device 9** are initiated.

After the coins are discharged from the extreme end part of the coin passage 2, they are delivered into a coin receiving sleeve 12 which constitutes a part of the coin packaging section (B) while they are guided by means of a guide member 11 having an arcuate guiding surface, until the predetermined number of coins are stacked on a pair of bottom plates 13 disposed at the lower end part of the coin receiving sleeve 12.

The counting device 10 is designed in such a manner as to initiate rotation of a packaging motor (as identified with reference numeral 218 in FIG. 8) by way of an electric circuit and thereby rotate a cam shaft 14 when the predetermined number of coins are counted. As the cam shaft 14 is rotated, some cams among a plurality of cams 15 are actuated and thereby a coin holding rod 16 constituting a part of the coin packaging section (B) is caused to move to the position located beneath wrapping rollers 17, 18 and 19 from the outside and it is then raised up to the elevated position close to the bottom plates 13. After the upward movement of the coin holding rod 16 comes to a stop, a solenoid for opening the bottom plate 13 (as identified with reference numeral 216 in FIG. 8) is energized whereby the bottom plates 13 are opened away from one another and the stacked structure of coins held in the coin receiving sleeve 12 is placed on the upper face of the holding rod 16. By lowering the latter, the stacked structure of coins is brought down to the working position defined by the wrapping rollers 17, 18 and 19. When it reaches the working position, the downward movement of the coin holding rod 16 comes to a stop.

Besides the receiving sleeve 12, the bottom plates 13 and the coin holding rod 16 the coin packaging section (B) includes the wrapping rollers 17, 18 and 19 which are adapted to move in such a direction that they join together with the aid of a certain cam among the group of cams 15, the adjustment cam 8 on the shaft 7 with the knob 6 fixed thereto and a linkage mechanism (nos shown) in operative association with the aforesaid cams and stop at the position spaced by a predetermined distance from the outer cylindrical surface of the stacked structure of coins. The above position where the wrapping rollers 17, 18 and 19 stop their approach movement is identical to a position where the stacked structure of coins is introduced into the working space defined by them. It should be noted that the wrapping rollers 17, 18 and 19 have assumed the above position prior to starting the downward movement of the coin holding rod 16. Specifically, the position of the wrapping rollers 17, 18 and 19 as defined by chain lines in FIG. 3 is identical to their outermost position which is kept unchanged irrespective of the kind and thickness of coins to be packaged, and as the cam shaft 14 is rotated they move from the outermost position toward the center point 0 at a constant speed while they are spaced at an equal distance from one another.

Figure 3:
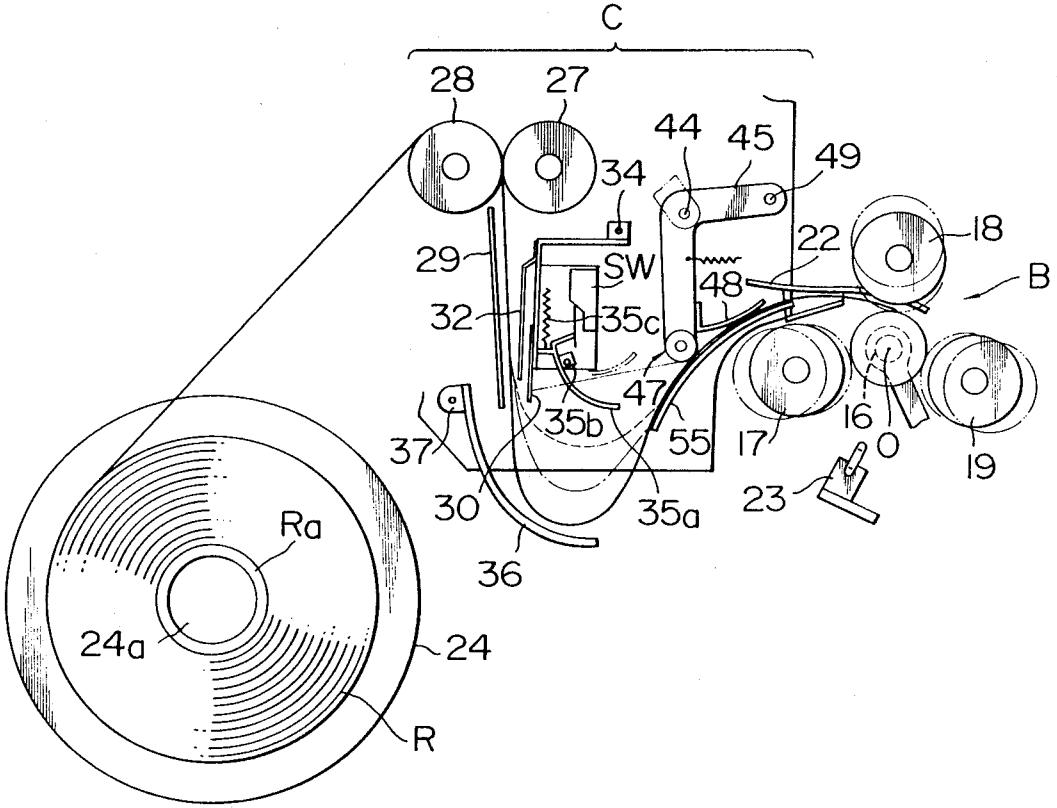

The position where the stacked structure of coins is introduced into the working space is identified with real lines in FIG. 3 and each of the wrapping rollers 17, 18 and 19 stops its movement when it reaches the above position.

Obviously, the last mentioned position varies in dependence on the kind and thickness of coins to be packed and a required position is determined by changing the position where a cam (not shown) in operative association with the shaft 7 including the knob 6 abuts against the linkage mechanism (not shown) serving to displace the wrapping rollers, while the distance between the latter and the stacked structure of coins is kept substantially constant irrespective of the kind of coins to be packaged. It should be noted that the position identified with another fragmental chain lines in FIG. 3 is identical to a position where the stacked structure of coins is held by the wrapping rollers 17, 18 and 19 while it is brought in contact with them.

It should be added that the structure and function of the above-mentioned parts and components as well as the mechanism for displacing the wrapping rollers 17, 18 and 19 are as described in the official gazette of Japanese Published Pat. No. 32317/78 and U.S. Pat. No. 3,886,957. The embodiment of the coin feeding section and the coin packaging section as illustrated in FIGS. land 3 is intended to be employed in countries in which there is a wide difference in diameter between the biggest and smallest current coins, but in other countries in which there is a close difference in diameter the above-mentioned adjustment is not required and therefore the wrapping rollers have from the outermost position (as represented by the chain lines in FIG. 3) directly to the holding position (as represented by the fragmental chain lines in FIG. 3) with no adjustment operation accompanied during their movement. In the illustrated embodiment the arrangement is made such that all of the three wrapping rollers move together. Alternatively, another arrangement may be made such that either a single wrapping roller or two wrapping rollers move while the residual ones or one is kept inoperative. Further, a manner of adjusting the position where the stacked structure of coins is introduced into the working space in correspondence on the kind of coins to be packaged should be not limited to the above-described one. Alternatively, the method as disclosed in the official gazette of Japanese Published Pat. No. 550/79 may be employed.

Next, a wrapping paper feeding device (C) constituting an essential part of the present invention will be described below.

A wrapping paper roll R around which a strip of wrapping paper is previously wound in a layered structure is rotatably held by means of a holding rod **24*a* standing upright on a holding plate 24, and the holding rod 24*a* is fitted into a roll core Ra of the wrapping paper roll R. The holding plate 24 is rotatably held on a support 25 of which root portion is fixedly secured to the bottom of a base plate 26 constituting a stationary framework of the coin packaging machine. It should be noted that the upper surface of the holding plate 24 is flush with the upper surface of the base plate 26**.

In the proximity of the wrapping paper roll R are disposed a pair of upright standing rollers 27 and 28 which serve to feed the strip of wrapping paper. The one wrapping paper feeding roller 27 is a driving roller which is connected directly to a pulse motor (as identified with reference numeral 222 in FIG. 8), whereas the other wrapping paper feeding roller 28 is a driven roller which is driven by means of the wrapping paper feeding roller 27 while it is brought in pressure contact with the latter under resilient force imparted by a spring means which is not shown in the drawings.

Further, in the proximity of the wrapping paper feeding rollers 27 and 28 is disposed a first upright standing wrapping paper guide 29 which is fixedly mounted on the base plate 26.

A cutting knife 30 serving to cut off the strip of wrapping paper is disposed opposite to the first wrapping paper guide 29 in such a manner that the strip of wrapping paper passes therebetween. As is best seen from FIG. 1(C), the cutting knife 30 is designed in the V-shaped configuration with a number of serrations formed along both the upper and lower edges thereof. The base portion of the cutting knife 30 is fixedly secured to a fixing plate 31.

Figure 1C:
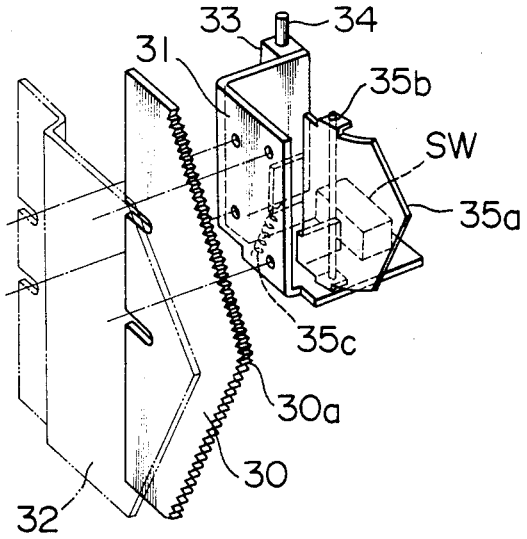
FIG. 1(C) is a perspective view of a cutting knife and its associated members, shown in a disassembled state.
Figure 1D:
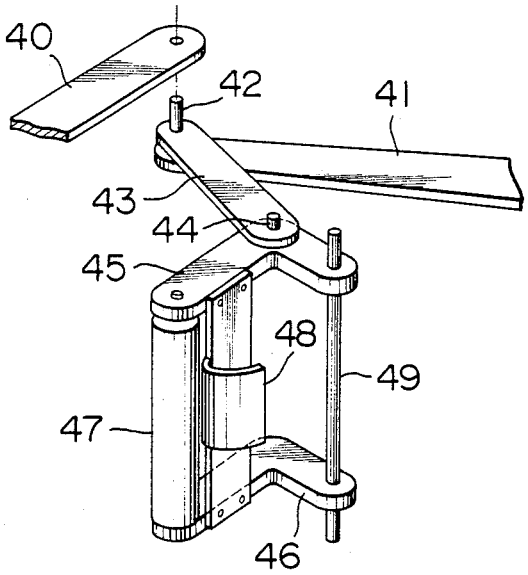
FIG. 1(D) is a perspective view of a wrapping paper retaining roller and its associated members, shown in a disassembled state.
Figure 1E:
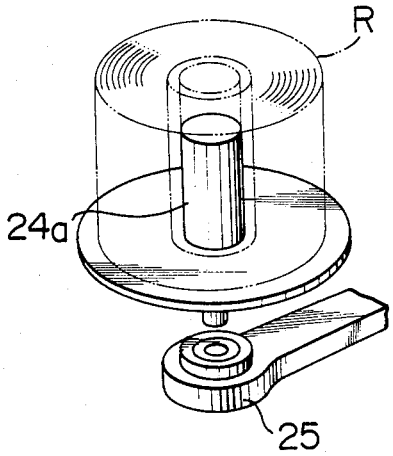
FIG. 1(E) is a perspective view of a wrapping paper roll and its associated members, shown in a disassembled state.
Figure 1F:
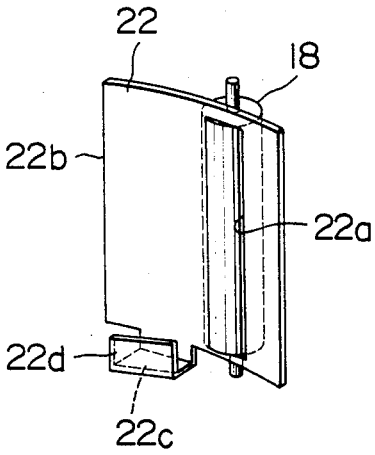
FIG. 1(F) is a perspective view of a wrapping paper guide disposed in a coin packaging section.

As illustrated in an enlarged scale in FIG. 1(C), the fixing plate 31 includes a leaf spring 32 fixedly secured thereto, said leaf spring 32 extending in parallel to the cutting knife 30. The fore part of the leaf spring 32 is designed in the V-shaped configuration similar to that of the cutting knife 30 and serves to urge the V-shaped fore end part of the strip of wrapping paper toward the first wrapping paper guide 29 after completion of cutting operation.

The fixing plate 31 has an L-shaped configuration as seen from the above with its rear part bent at a right angle so that it is fixedly secured to a supporting member 33 by way of the bent part.

The supporting member 33 includes a guide shaft 34 extending therethrough in the vertical direction so that it is adjustably displaced upward and downward. The upward or downward adjustment is carried out due to the facts that the upper surface of the base plate 26 functions as a reference for defining the lower end of a wrapping paper of which width is selectively determined in dependence on the height of a stacked structure of selected kind of coins and the stacked structure of coins is held at a predetermined position in the working space defined by the wrapping rollers 17, 18 and 19 (wrapping position) by means of the holding rod 16 irrespective of the kind of coins to be packaged whereby the central position of the wrapping paper as seen in the transverse direction thereof varies in dependence on the kind of coins to be packaged and therefore there is a necessity for aligning the V-shaped apexes of both the cutting knife 30 and a detecting piece 35*a* to be described later with the central position of the wrapping paper. For the reasons as described above the fixing plate 31 is vertically displaced by means of an adjustment device (as identified with reference numeral 800 in FIG. 8) which is in operative association with the shaft 7 including the knob 6 and thereby the cutting knife 30, the leaf spring 32, the detecting piece 35*a* and the wrapping paper cutting-off detecting switch SW (as identified with reference numeral 224 in FIG. 8) are caused to move up or down in union in conformance with the vertical displacement of the fixing plate 31.

The detecting piece 35*a* is held swingably about an upright standing support shaft 35*b* and it includes a switch actuating portion adapted to actuate the detecting switch SW (as identified with reference numeral 224 in FIG. 8) and a stopper portion adapted to abut against the fixing plate 31 under resilient force imparted by a coil spring 35*c*.

Further, a movable wrapping paper guide 36 constituting a wrapping paper guide wall member is disposed downstream of the first wrapping paper guide 39. The inner guide wall surface of the movable wrapping paper guide 36 along which the strip of wrapping paper passes has an arcuate configuration as seen from the above and a support shaft 37 stands upright at the base part of the movable wrapping paper guide 36 in such a manner as to extend therethrough. The support shaft 37 is rotatably held by means of the base plates 26 (of which upper one is not shown in the drawings) through which both the upper and lower end parts of the support shaft 37 extends in the vertical direction. Further, the support shaft 37 includes a swingable plate 38 fixedly secured thereto at its upper end and a pin 38*a* is disposed at other end part of the swingable plate 38 which is projected through an elongated hole 40*a* of a connecting plate 40. A coil spring 39 is bridged between the pin 38*a* and the connecting plate 40 in such a manner as to draw the former toward the latter under resilient force of the coin spring 39.

The other end part of the connecting plate 40 is pivotally connected to the one end of a lever 41 by way of a pin 42 which is fixed to the latter but loosely fitted through the former. Further, the pin 42 is loosely fitted through the one end part of an actuating lever 43. The other end part of the latter is pivotally connected to the middle part of a bent arm 45 by way of a pin 44 extending therethrough.

A lower bent arm 46 having the same configuration as that of the bent arm 45 is disposed in vertical alignment with the latter and a wrapping paper retaining roller 47 is rotatably held between the one end parts of both the upper and lower bent arms 45 and 46. A wrapping paper guide 48 is located adjacent to the upright standing roller 47 by attaching it to a plate bridged between both the upper and lower bent arms 45 and 46.

The pair of bent arms 45 and 46 are held rotatably about an upright standing support shaft 49 extending through the other end parts thereof in such a manner that they are normally urged under resilient force of a coil spring 50 in the anticlockwise direction as seen in the drawings.

The lever 41 is rotatably held by means of a shaft 51 located at the middle part thereof so that it is rotatable about the shaft 51 in a horizontal plane. Further, the lever 41 carrys a cam follower 52 pivotally held at its other end part which is adapted to come in contact with a cam 53 among the group of cams 15 under resilient force imparted by a coil spring 56.

Figure 2:
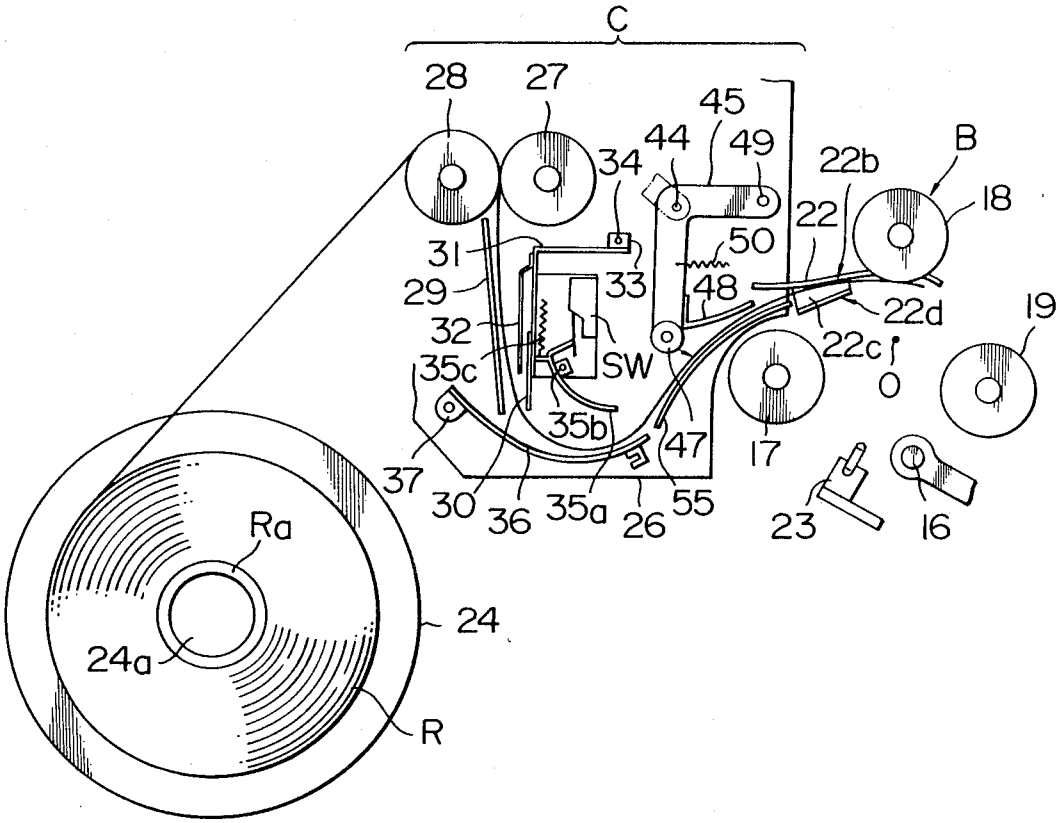

On the base plate 26 is fixedly mounted a second wrapping paper guide 55 which constitutes another part of the wrapping paper guide wall. As is apparent from the drawings, the second wrapping paper guide 55 has a reverse arcuate configuration relative to the movable wrapping paper guide 36 as seen from the above and it constitute a continuous wrapping paper guide wall when the movable wrapping paper guide 36 is turned to the closed position (as illustrated in FIGS. 1 and 2).

Next, operation of the wrapping paper feeding device in accordance with the illustrated embodiment will be described in the following. In this connection it should be noted that an electrical control section for the wrapping paper feeding device of the invention will be described later with reference to FIG. 8.

When the kind of coins to be packaged is to be changed, an adjustment is first made such that the cutting knife 30, the leaf spring 32, the detecting piece 35*a* and the switch SW are displaced upward or downward in conformance with the selected kind of coins to be packaged by actuating the knob 6 so that the apex of the V-shaped cutting knife 30 is located in correct alignment with the horizontally extending center line of the wrapping paper. After completion of the adjustment for the correct working position a wrapping paper roll R is fitted onto the upright standing holding rod 24*a*. On the other hand, when the kind of coins to be packaged is not changed, there is no necessity for actuating the knob 6 and the empty roll core Ra is replaced with a new wrapping paper roll R.

After the wrapping paper roll R including the roll core Ra is stationarily placed on the holding plate 24, the leading end of the wrapping paper is peeled off from the roll R and it is then introduced into the clearance between both the feeding rollers 27 and 28. Next, the movable wrapping paper guide 36 is opened by manually turning it about the upright standing support shaft 37 whereby the leading end of the wrapping paper is drawn past the clearance between both the feeding rollers 27 and 28.

As the cutting knife 30 is thrusted against the wrapping paper after the latter is unreeled from the wrapping paper roll R, the cut end of the wrapping paper is urged toward the first wrapping paper guide 29 under the resilient force imparted by the leaf spring 32 and thereby it is kept against the latter.

The movable wrapping paper guide 36 is held in the closed state as illustrated in FIGS. 1 and 2.

Next, when a wrapping paper setting button (not shown) is depressed, a wrapping paper setting switch (as identified with reference numeral 225 in FIG. 8) is actuated and thereby a predetermined number of pulses are issued to the pulse motor whereby the wrapping paper feeding roller 27 is rotated by a predetermined angle of rotation so that the wrapping paper unreeled from the wrapping paper roll R is delivered by a predetermined length from the wrapping paper feeding roller 27 in cooperation with the follower roller 28. At this moment the leading end part of the wrapping paper having the V-shaped configuration moves along the first wrapping paper guide 29, the movable wrapping paper guide 36 and the second wrapping paper guide 55, abuts against the wrapping paper guide 48, then moves further along the latter and finally reaches the position as shown in FIG. 2 while it is guided along the wrapping paper guide surface 22*b* of the wrapping paper guide 22. It should be noted that the lower end part of the moving wrapping paper is guided on the upper surface of the base plate 26 as well as the lower guide portion 22*c* of the wrapping paper guide 22. Further, it should be noted that while the wrapping paper moves along the wrapping paper guide 48 and the wrapping paper guide surface 22*b* the second wrapping paper guide 55 located opposite to the wrapping paper guide 48 and the wrapping paper guide portion 22*d* located opposite to the wrapping paper guide surface 22 are effective in preventing the leading end part of the wrapping paper from moving in a wrong direction and correcting it.

When the leading end part of the wrapping paper reaches the position as shown in FIG. 2, the wrapping paper feeding roller 27 is caused to stop its operation and thereby the leading end part of the wrapping paper is kept immovable while it is brought in contact against the wrapping roller 18.

Next, when a start button is depressed and thereby the start switch (as identified with reference numeral 212 in FIG. 8) is actuated, the coin feeding section (A) is energized by way of the control circuit. As a result a certain number of coins are delivered from the coin supply device onto the rotary disc 1, they are arranged in circular alignment one after another along the peripheral wall of the rotary disc 1 due to the centrifugal force caused by the rotation of the latter, while assuming the horizontal posture, and they are then introduced into the coin passage 2 at a certain position located on the peripheral wall of the rotary disc 1, said coin passage 2 extending therefrom in the outward direction.

The coins introduced into the coin passage 2 are forwarded by means of the coin conveyance device 9. During the conveyance of the coins the wrong ones having a smaller diameter or the like are removed via the groove 5 and thus only the normal coins are counted by means of the counting device 10. They are then discharged into the coin receiving sleeve 12 one by one. When the predetermined number of coins to be packaged are counted, the stopper rod 10*a* is caused to protrude into the coin passage 2 and further discharge of the coins is inhibited thereby. Thus, the predetermined number of coins are stacked in the coin receiving sleeve 12. At this moment the coin delivery device, the rotary disc 1 and the coin conveyance device 9 become inoperative. On the other hand, the counting device 10 issues a signal to the control circuit immediately after the predetermined number of coins to be packaged are counted so that the packaging motor (as identified with reference numeral 218 in FIG. 8) starts its rotation and the cam shaft 14 is then rotated. As rotation of the cam shaft 14 is initiated, the holding rod 16 is displaced in the traverse direction until it reaches the center point O of the working space as defined by the wrapping rollers 17, 18 and 19, and it is then raised up to the elevated position. At this moment the cam follower 52 on the lever 41 moves into the smaller diameter part of the cam 53 on the cam shaft 14 from the larger diameter part of the same whereby the lever 41 is caused to turn about the shaft 51 in the anticlockwise direction as seen in the drawing. As a result the connecting plate 40 is thrusted forward by means of the lever 41 and thereby the swingable plate 38 is caused to swing about the upright standing shaft 37 in the clockwise direction as seen in the drawing.

On the other hand, the lever 41 allows the actuating lever 43 to move whereby the retaining roller 47 is turned about the upright standing support shaft 49 until it urges the wrapping paper against the second wrapping paper guide 55. At the same time the wrapping rollers 17, 18 and 19 are displaced toward the working position (as identified with real lines in FIG. 3) with the aid of the group of the cams 15 on the cam shaft 14. At this moment the movable wrapping paper guide 36 and the retaining roller 47 assume the position as shown in FIG. 3, whereas the wrapping rollers 17, 18 and 19 are located at the position as represented by the real lines in FIG. 3.

When the above-described positions have been reached, the pulse motor (as identified with reference numeral 222 in FIG. 8) starts its operation and thereby the wrapping paper feeding roller 27 is rotated by a predetermined angle of rotation. It should be noted that the pulse motor is rotated only when the kind of coins to be packaged has a medium size of diameter or a large size of diameter. Specifically, when it is assumed that all kinds of coins to be packaged are classified into three groups, that is, a group of large size of diameter, a group of medium size of diameter and a group of small size of diameter in dependence of the diameter of coins, additional feeding is carried out by a predetermined length of wrapping paper while the wrapping paper retaining roller 47 and the movable wrapping paper guide 36 occupy their position as illustrated in FIG. 3 in case of the group of medium size of diameter, whereas additional feeding is done by a longer length than the preceding one in case of a group of large size of diameter. For the reason as mentioned above the time when the pulse motor starts its operation is same for both the groups of medium size of diameter, but the more number of pulses are applied to the pulse motor in case of the group of large size of diameter than that in case of the group of medium size of diameter. It should be noted that in case of coins belonging to the group of small size of diameter the pulse motor does not start its rotation at that moment.

Accordingly, in case of the kinds of coins belonging to the group of small size of diameter the wrapping paper assumes the position as represented by a dotted line in FIG. 3, in case of those of medium size of diameter it does that represented by a chain line and in case of those of large size of diameter it does that represented by a real line. In case of the latter two groups of coins additional feeding is carried out by the length as represented by the chain line and the real line and after completion of the additional feeding of the wrapping paper the pulse motor comes to a stop and thereby the wrapping paper feeding roller 27 becomes inoperative.

At a predetermined time after the wrapping paper feeding roller 27 is stopped (immediately after the wrapping paper feeding roller 27 is stopped in case of coins belonging to the group of large size of diameter) the stacked structure of coins introduced into the working space defined by the wrapping rollers 17, 18 and 19 and held at the packaging station by means of the holding rod 16 is brought in pressure contact with the wrapping rollers 17, 18 and 19 as it is clamped by them. Immediately after pressure contact is effected therebetween the wrapping rollers 17, 18 and 19 start their rotation and thereby the stacked structure of coins is caused to rotate.

The leading end of the wrapping paper has already reached the position close to the wrapping roller 18 and it moves along the wrapping paper guide 22 toward the wrapping roller 19. Further, it moves along the wrapping paper guide of the latter toward the wrapping roller 17 until it is wound round the stacked structure of coins.

At this moment it is rapidly stretched so that the subsequent part of wrapping paper becomes stretched linearly. Namely, the loosened part of the wrapping paper located in the area of the movable wrapping paper guide 36 moves toward the position as represented by the two-dot chain line within a short period of time from the position as represented by the real line in case of the kind of coins belong to the group of large size of diameter, from that by the chain line in case of the kind coins of medium size of diameter and from that by the dotted line in case of the kind of coins of small size and thereby it becomes stretched.

As the wrapping paper is displaced in that way, it is brought in engagement to the V-shaped cutting edge of the cutting knife 30 and thereby it is cut off along the peripheral lines of the cutting edge under the stretched tension caused by the above displacement thereof. The cutting operation is completed while the wrapping paper is displaced to the position as represented by the two-dot chain line.

On completion of the cutting operation the subsequent leading end part of the wrapping paper is thrusted toward the first wrapping paper guide 29 under the resilient force of the leaf spring 32 and it is then held therealong.

It should be noted that while the wrapping paper becomes stretched prior to carrying out the cutting operation with the aid of the cutting knife 30 the detecting piece 35*a* abuts against the web surface of the wrapping paper and then it follows the displacement of the latter against the resilient force of the coil spring 35*c* under the stretched tension. When the wrapping paper is displaced to the position as represented by the two-dot chain line and the required cutting operation is completed, the detecting piece 35*a* reaches the position as represented by the chain line and the detecting switch SW (as identified with reference numeral 224 in FIG. 8) is changed over whereby the packaging mechanism (as identified with reference numeral 700 in FIG. 8) including the wrapping rollers 17, 18 and 19, the holding rod 16, the twisting hooks 23 and others practices a normal packaging cycle. Namely, the cam shaft 14 continues its rotation until it resumes the initial position, while the wrapping rollers 17, 18 and 19 continue to rotate.

Provided that the wrapping paper fails to be cut off, for instance, in case when the wrapping paper roll R becomes empty or when the leading end part of the wrapping paper fails to reach the position close to the wrapping roller 18 due to an occurrence of clogging of the feeding passage with the wrapping paper, and thereby the detecting switch SW (as identified with reference numeral 224 in FIG. 8) fails to be shifted (including the case where the switch shifting is not carried out within the predetermined period of packaging cycle), the wrapping rollers 17, 18 and 19 stop their rotation and the pulse motor for driving the wrapping paper feeding roller 27 within the predetermined period of packaging cycle is inhibited from further rotation, although the cam shaft 14 continues its rotation until the initial position is restored.

The tail end part of a piece of wrapping paper normally cut off in that way is urged backward as the detecting piece 35*a* is displaced to the position as represented by the real line under the resilient force of the coil spring 35 and it is forwarded toward the wrapping roller 18. While it continues its forward movement, it is wound round the stacked structure of coins.

At this moment the cam follower 52 at the one end of the lever 41 moved onto the larger diameter part of the cam face of the cam 53 from the smaller diameter part of the same on the cam shaft 14 whereby the lever 41 is caused to turn about the shaft 51 in the clockwise direction and the wrapping paper guide 36 and the wrapping paper retaining roller 47 resumes the initial position respectively. Immediately after the original positions are restored the predetermined number of pulses are applied to the pulse motor (as identified with reference numeral 222 in FIG. 8) so as to rotate the same by the predetermined angle of rotation whereby the leading end part of the wrapping paper is caused to move forward from the position in the proximity of the cutting knife 30 along the closed movable wrapping paper guide 36 and the second wrapping paper guide 55.

On the other hand, the packaging mechanism (as identified with reference numeral 700 in FIG. 8) has the cut piece of wrapping paper wound round the stacked structure of coins and the projected parts of the cut piece of wound wrapping paper at both the upper and lower ends thereof are folded while they are twisted by means of the twisting hooks 23. Next, lowering and transverse displacement of the holding rod 16, upward and downward disengagement and transverse displacement of the twisting hooks 23, stoppage of rotation of the wrapping rollers 17, 18 and 19 with the stacked structure of coins held in the working space defined by them and outward displacement of the wrapping rollers 17, 18 and 19 toward their outermost position are carried out at the same time. As a result the stacked structure of coins having the wrapping paper wound therearound is released from the holding state. It should be noted that the reason why the stacked structure of coins is released from the holding state after the wrapping rollers 17, 18 and 19 becomes inoperative consists in that there is a danger of damaging the packaged structure of coins while it passes through a discharge trough means located below the packaging mechanism or when it is received in a receiving box, if it is thrown down while it is rotated by means of the rotating wrapping rollers.

Immediately after the wrapping rollers 17, 18 and 19 resumes the position as illustrated in FIG. 2 (the outermost position), the leading end part of the wrapping paper reaches the position in the vicinity of the wrapping roller 18 and then it comes to a stop. At this moment the cam shaft 14 has completed one revolution and resumes the starting position. As a result one cycle of packaging operations are completed.

On the other hand, the coin feeding section (A) starts its operation again immediately after the bottom plates 13 disposed at the lower end of the coin stacking sleeve 12 are displaced toward one another to the closed position, while the stopper rod 10*a* moves backward Now coin counting is ready to start. It should be noted that the cam shaft 14 is kept stopped at the starting position so as to be ready to rotate for the next cycle of packaging operation, if the counting device 10 fails to complete its counting operation for the predetermined number of coins, whereas the cam shaft 14 continues to rotate any interruption of rotation for the next cycle of packaging operations, if the counting device 10 has completed its counting operation.

FIG. 8 is a block diagram which schematically illustrates an operative relation among the electric control members and associated members adapted to be controlled thereby directly or indirectly. In the drawing operative connections achieved by electrical signals are represented by real lines, whereas operative connections achieved by mechanical power transmission are represented by dotted lines.

The knob 6 in the control section 200 adapted to determine a kind of coins to be packaged is operated so as to selectively determine it, whereas the knob 201 adapted to determine a predetermined number of coins to be packaged is operated so as to selectively determine it (for instance, 25 pieces, 40 pieces, 50 pieces or the like) in cooperation with a predetermined number generating device 202. (Alternatively, the knob 6 may undertake the function to be carried out by the predetermined number generating device 202). On the other hand, signals issued from a coin detector 203 in the counting device 10 disposed in the coin passage are counted in a counting circuit 204. Further, a coincidence detecting circuit 205 is provided so as to allow the informations obtained from the predetermined number generating device 202 to coincide with the result of counting in the counting circuit 204 so that a counting result coincidence signal 205*p* generated when a coincidence takes place is inputted into a coin delivery control circuit 206 and a packaging control circuit 214. As will be described later, the counting result coincidence signal 205*p* is utilized as a packaging operation starting timing signal in the packaging control circuit 214. The coin delivery control circuit 206 is designed so as to control a coin supply motor 207, a counting motor 208 and a stop solenoid 209 whereby a coin supply device 210, the rotary disc 1, the coin conveyance device 9 and the stopper rod 10*a* are caused to become operative or inoperative.

Further, the control section 200 includes a clear switch 211, a start switch 212 and a stop switch 213 and signals from the clear switch 211 are inputted into the counting circuit 204, the coin feeding control circuit 206 and the packaging control circuit 214.

As will be apparent from the above description, the control section 200 is constructed of the knob 6 for determining a kind of coins to be packaged, the knob 201 for determining a predetermined number of coins to be packaged, the clear switch 211, the start switch 212, the stop switch 213 and others, whereas the counting section 300 is constructed of the predetermined number generating device 202, the counting circuit 204, the coin detector 203, the coincidence detecting circuit 205, the coin feeding control circuit 206, the coin supply motor 207, the countingg motor 208, the stop solenoid 209, the coin supply motor 210, the rotary disc 1, the coin conveyance device 9 and others. (In this connection it should be noted that adjustments or controls carried out in the purely mechanical manner, for instance, adjustment for determining the width of the coin passage or the like are not illustrated in FIG. 8). Further, the counting device generally identified with reference numeral 10 in FIG. 1 is constructed of a predetermined number generator 202, a coin detector 203, a counting circuit 204, a coincidence detecting circuit 205, a stop solenoid 209 and others.

A packaging control circuit 214 is connected to a sequence controller 215 which is in turn connected to a shutter solenoid 216, a packaging roller clutch 217 and a packaging motor 218. The last mentioned packaging motor 218 serves to actuate a displacement mechanism 219. Further, determining circuit 220 is provided which will be described later. An operation control section 400 is constructed of the above-mentioned circuit and others.

Specifically, the determining circuit 220 is designed so as to generate any one of a small size coin wrapping paper determining signal, a medium size coin wrapping paper determining signal and a large size coin wrapping paper determining signal. A wrapping paper feeding control circuit 221 connected to the determining circuit 220 is adapted to receive a signal 215*p* from the sequence controller 215 so that a pulse motor 222 is rotated and thereby the wrapping paper feeding roller 27 is rotated.

The displacement mechanism serves to displace a packing mechanism 700, the wrapping paper retaining roller 47 and the movable wrapping paper guide 36 in a wrapping paper feeding section 500 while they are controlled. Further, an adjustment device 800 is adapted to carry out adjustment by operating the knob 6 for determining the kind of coins to be packaged so that the displacement mechanism 219 is adjusted and thereby the wrapping rollers 17, 18 and 19 and the twisting hooks 23 in the packaging mechanism 700 are adjusted. Additionally, the adjustment device 800 carries out adjustment with respect to upward or downward displacement of the cutting knife 30 and vertical operative position of a paper cut-off detecting switch 224 in an abnormality detecting section 600.

The wrapping paper feeding section 500 is constructed of the wrapping paper feeding control circuit 221, the pulse motor 222, the wrapping paper feeding roller 27, the wrapping paper retaining roller 47, the movable wrapping paper guide 37, the cutting knife 30 and others.

In addition to the wrapping paper cut-off detecting switch 224 a configurative irregurality detecting switch 223 is provided and they are in electrical connection with the packaging control circuit 214.

In order to ensure that the leading end part of a strip of wrapping paper from a new wrapping paper roll R is automatically displaced to a predetermined position a wrapping paper set switch 225 adapted to be manually operated is provided which is connected to the wrapping paper feeding control circuit 221.

The bottom plates 13 disposed at the lower end of the coin receiving sleeve 12 in the wrapping mechanism 700 are actuated by means of the shutter solenoid 216, whereas the wrapping rollers 17, 18 and 19, the twisting hooks 23 and the holding rod 16 are displaced by means of the displacement mechanism 219.

A relation between FIGS. 3 and 8 will be described further below.

Figure 9:
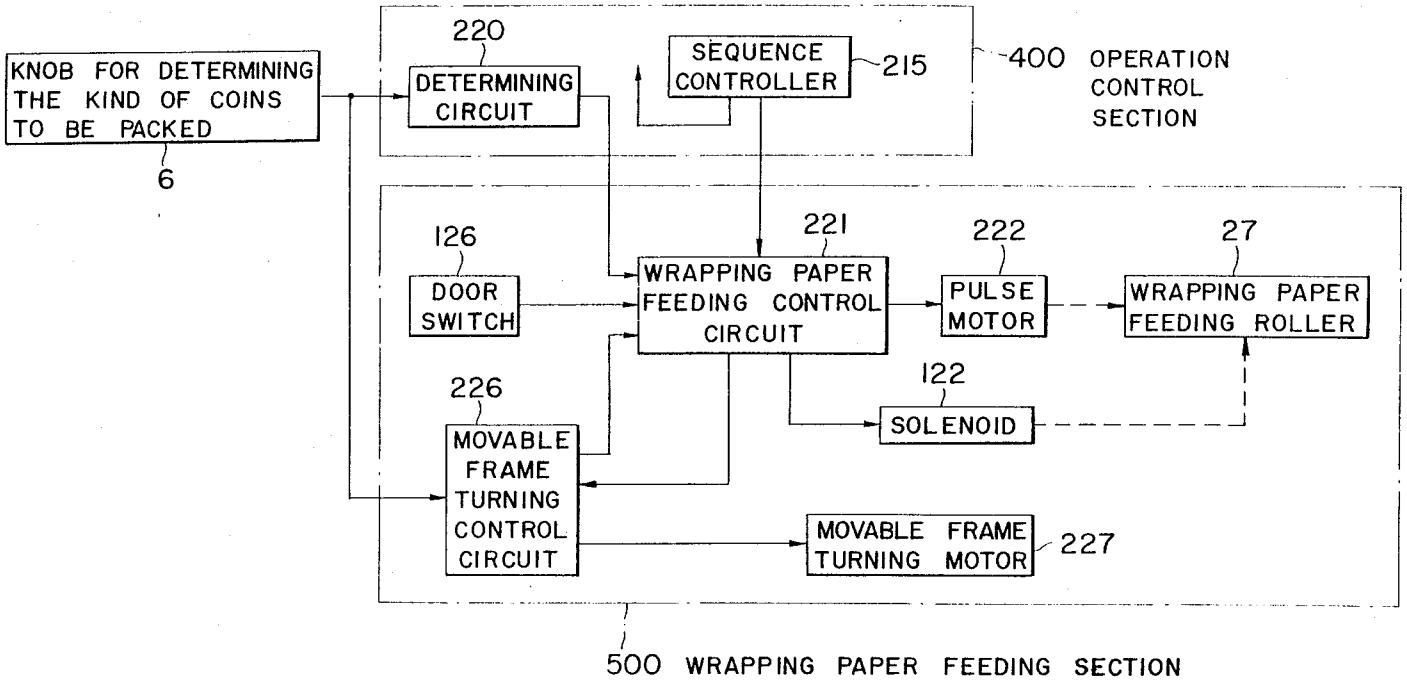
FIG. 9 is a block diagram of electrical control section with respect to the fourth embodiment.

The displacement mechanism in FIG. 9 corresponds to a mechanism (not shown) for displacing the cam shaft 14, the group of cams 15, the cam 53, the cam follower 52, the lever 41, the support shaft 51, the coil spring 56, the pin 42, the actuating lever 43, the connecting plate 40, the coil spring 39, the swingable plate 38, the pin 38*a*, support shaft 39 and the wrapping rollers 17, 18 and 19 and a mechanism (not shown) for displacing the twisting hooks 23 and the holding rod 16.

The wrapping paper feeding mechanism 800 in FIG. 8 comprises a holding mechanism including the wrapping paper retaining roller 47, the arm 45, the coil spring 50 and the second wrapping paper guide 55 and a feeding roller section including the wrapping paper feeding rollers 27 and 28.

When the clear switch 211 is shifted by way of push button operation a clear signal is inputted into the counting circuit 204 so as to clear the content of counting. The clear signal is inputted further into the coin feeding control circuit 206 and thereby a coin feeding motor 207 and a counting motor 208 are caused to rotate in the reverse direction and then come to a stop within a predetermined period of time (about one second). Specifically, the coin supply device 210, the rotary disc 1 and the coin conveyance device 9 are rotated in the opposite direction for the predetermined period of time so that the existence of residual coins in the coin supply device 210 is confirmed and they are restored to the position where they are removed therefrom. When an operator confirms that some residual coins are seen in the device, he removes them by his hand.

Further, the clear signal is inputted into the packaging control circuit 214. During the beginning part of operation the sequence controller 215 is operated such that it receives a signal from the packaging control circuit 214 and thereby only the shutter solenoid 216 is excited for a predetermined period of time whereby the bottom plates 13 are opened and the less number of coins held in the coin stacking sleeve 12 (referred to as coins having a lack in "the predetermined number of coins to constitute a packaging unit") are discharged downward therefrom. After completion of the discharging of the residual coins the solenoid 216 becomes demagnetized and the bottom plates 13 are then displaced toward one another to close the coin passage. While the residual coins are discharged, the wrapping rollers 17, 18 and 19, the twisting hooks 23 and the holding rod 16 are restored to the initial operative position (the wrapping paper retaining roller 47 and the movable wrapping paper guide 36 are also restored to the initial operative position) and therefore the coins having the less number than the specified one fall down without any fear of interference with the above-mentioned components.

When the sequence controller 215 does not assume the initial operative position (for instance, when the coin packaging machine is caused to stop by actuating the stop switch 213 in the course of the packaging cycle and thereby the cam shaft 14 is located midway of a single rotation), it receives a signal from the packaging control circuit 214 and the packaging motor 218 is then rotated until the cam shaft 14 in the displacement mechanism 219 is restored to the initial operative position. As a result the wrapping rollers 17, 18 and 19, the twisting hooks 23, the holding rod 16, the wrapping paper retaining roller 47 and the movable wrapping paper guide 36 are restored to their initial operative positions. When they resume their initial operative positions, the sequence controller 215 becomes effective in exciting the shutter solenoid 216 at a predetermined period of time and thereby the bottom plates 13 are displaced away from one another to open the coin passage so that the residual coins held in the coin stacking sleeve 12 is discharged from the latter. (It should be noted that the shutter solenoid 216 is normally magnetized midway of the packaging cycle, but when clearing is effected, it is not magnetized midway of the packing cycle but at a time when the initial operative position is resumed.) Further, the sequence controller 215 is constructed such that the packaging roller clutch 219 is turned off and thereby no rotation is transmitted to the wrapping rollers 17, 18 and 19 while the displacement mechanism is restored to the original operative position.

When all the parts of the coin packaging machine resume their initial operative positions, the knob 6 is operated until a required kind of coins to be packaged is determined. This causes the coin passage 2 to be adjusted with respect to its width. Further, the determining circuit 220 is electrically adjusted to one of three feeding lengths of the wrapping paper (for packaging coins having large size of diameter, those of medium size of diameter or those of large size of diameter) and the adjustment device 800 is then actuated. Specifically, the adjustment device 800 is actuated in such a manner that the height of the upper twisting hooks 13 is adjusted with the aid of the displacement mechanism 219, the wrapping rollers 17, 18 and 19 are displaced to the working position where the wrapping cycle is practiced and the cutting knife 30 and the wrapping paper cut-off detecting switch 224 is adjusted with respect to its vertical position. If there is necessity for packaging a stacked structure of coins of other kind of which specified number of coins to be packaged is different from that of the preceding packaging cycle, the knob 201 for determining the number of coins to be packaged is operated so as to change the unit number of coins in the predetermined number generator 202. Next, the wrapping paper roll R for the preceding packaging cycle is removed from the holding rod 24*a* after the leading end part of the wrapping paper is disengaged from the wrapping paper feeding passage and a new wrapping paper roll R selected for the required kind of coins to be packaged is then fitted into the holding rod 24*a* with the V-shaped leading end part of the new wrapping paper extended through the clearance between the wrapping paper feeding rollers 27 and 28 to the position located adjacent to the side wall of the cutting knife 30. It should be noted that the foregoing description is referred to the case where the wrapping paper roll R is in normal use and in case of a new wrapping paper roll R the V-shaped leading end part thereof is prepared by way of the steps of peeling off the leading end part of the wrapping paper from the outer peripheral surface of the wrapping paper roll R, allowing it to pass through the clearance between the wrapping paper feeding rollers 27 and 28 while keeping the movable wrapping paper guide 36 opened and then thrusting it against the V-shaped cutting edges of the cutting knife 30. Thus, the obtained V-shaped leading end part of the wrapping paper is located by the side wall of the cutting knife 3C. When the movable wrapping paper guide 36 is released from the opened state, it is restored to the original closed position under resilient force imparted by the coil spring 39.

When the wrapping paper set switch 225 is turned on by way of push button operation with the last mentioned closed state maintained, a signal is inputted into the wrapping paper feeding control circuit 221 and thereby a predetermined number of pulses from the latter are applied to the pulse motor 222 whereby the wrapping paper feeding roller 27 is rotated by a predetermined extent (by a predetermined angle of rotation) and the leading end part of the wrapping paper is brought to the position located by the wrapping roller 18 via the wrapping paper guides 36 and 55, as illustrated in FIG. 2. Next, the required kind of coins are charged into the coin supply device when the above-mentioned operative position has been reached. As the start switch 212 is turned on, a start command is issued to the coin feeding control circuit 206 and the coin supply motor 207 and the counting motor 208 are rotated while the coin supply device 210, the rotary disc 1 and the coin conveyance device 9 become operative. Thus, the coins pass through the coin passage 2 and fall down in the coin receiving sleeve 12 until a predetermined number of coins are stacked therein. The stacked structure of coins are detected one by one while they pass through the coin passage 2 and the result of detections is counted in the counting circuit 204. When the counted value coincides with the predetermined counting value stored in the predetermined number generator 202, a coincidence detecting signal 205*p* from the coincidence detecting circuit 205 is inputted into the coin feeding control circuit 206 and then the latter becomes effective in stopping the operation of both the coin supply motor 207 and the counting motor 208 and magnetizing the stop solenoid 209 at the same time. As a result it is ensured that any coin in excess of the predetermined number is prevented from entering into the coin receiving sleeve 12. The stoppage of the motors 207 and 208 cause the coin supply device 210, the rotary disc 1 and the coin conveyance device 9 to become inoperative.

On the other hand, the coincidence detecting signal 205*p* from the coincidence detecting circuit 205 is inputted into the packaging control circuit 214 as a packaging operation start timing signal. As a result a signal 214*p* is inputted into the sequence controller 215 from the packaging control circuit 214 whereby the packaging motor 218 is caused to rotate and thereby the cam shaft 14 in the displacement mechanism 219 starts its operation. Consequently, the wrapping rollers 17, 18 and 19 are displaced from their outermost position to the intermediate position where the stacked structure of coins is ready to be introduced and once they have reached to the last mentioned position they come to a stop. At this moment the holding rod 16 enters the working space defined by the wrapping rollers 17, 18 and 19 and it is then raised up to the elevated position located beneath the bottom plates 13. Once it has reached the elevated position it comes to a stop. At this moment a signal is inputted into the shutter solenoid 216 from the sequence controller 215, causing the bottom plates 13 to be opened. Now the stacked structure of coins is ready to be placed on the holding rod 16.

When the stacked structure of coins is placed on the holding rod 16 to be held thereby, the latter starts its downward movement and is lowered through the working space defined by the wrapping rollers 17, 18 and 19 until the working position is reached in which wrapping operation is practiced. Once the last mentioned position has been reached the holding rod 16 comes to a stop. At this moment the wrapping rollers 17, 18 and 19 are quickly displaced from the aforesaid intermediate position to the working position where they are brought in pressure contact with the stacked structure of coins which has been introduced into the working space. Since the leading end part of the wrapping paper has been located by the wrapping roller 18 at this time the result is that it is held between the wrapping roller 18 and the stacked structure of coins.

While the wrapping rollers 17, 18 and 19 are displaced from the outermost position to the intermediate one in that way, the wrapping paper retaining roller 47 becomes effective in thrusting the wrapping paper at a predetermined position by means of the cam 53 on the cam shaft 14 with the movable wrapping paper guide 36 kept opened. At this moment the signal 215*p* is inputted from the sequence controller 215 into the wrapping paper feeding control circuit 221 in case when coins belonging to the group of medium size of diameter and large size of diameter are to be packed and the number of pulses selectively determined in the determining circuit 220 corresponding to the group of medium size of diameter or large size of diameter are then applied to the pulse motor 222 whereby the wrapping paper feeding roller 27 is rotated by an angle of rotation corresponding to the selected group of coins. As a result a length of wrapping paper corresponding to the above angle of rotation is caused to enter the holding space defined by the movable wrapping paper guide 36 which has been turned to the opened position. (It should be noted that the wrapping paper feeding roller 27 is rotated at that time in case when coins belonging to the group of small size of diameter are to be packaged.) After the wrapping paper feeding roller 27 stops its rotation the wrapping rollers 17, 18 and 19 are urged to hold the stacked structure of coins. When the stacked structure of coins becomes held by them, a wrapping roller clutch 217 is actuated by means of the sequence controller 215 and rotation of the packaging motor 218 is transmitted to the wrapping rollers 17, 18 and 19 by way of the wrapping roller clutch 217 whereby the stacked structure of coins is rotated and thereby the wrapping paper is wound round it. This causes the subsequent part of the wrapping paper to be quickly stretched with the result that it is thrusted against the cutting edges of the cutting knife 30 until it is cut off. On completion of the cutting operation the wrapping paper cut-off switch 224 is actuated by means of the wrapping paper cut-off detecting piece 35*a* (see FIG. 3) and a detecting signal 224*p* is inputted into the packaging control circuit 214. At this moment a wrapping paper cut-off detection timing signal 215*t* has been inputted into the packaging control circuit 214 from the sequence controller 215 for a predetermined period of time and when the detecting signal 224*p* is inputted into the packaging control circuit 214 from the wrapping paper cut-off switch 224 within the aforesaid period of time, a normal packaging cycle continues. If the signal 224*p* fails to be inputted into the packaging control circuit 214 from the wrapping paper cut-off switch 224 within the above period of time, a signal 214*r* is inputted into the sequence controller 215 from the packaging control circuit 214 and thereby the wrapping rollers 17, 18 and 19 are interrupted from rotation caused by the packaging motor 218 with the wrapping roller clutch 217 disengaged. Further, the pulse motor 222 is inhibited from starting of its rotation, because a signal 215*s* fails to be inputted into the wrapping paper feeding control circuit 221 from the sequence controller 215. (At this moment the pulse motor 222 is kept still in a stopped state.) When a structural abnormality detecting switch 223 detects any abnormality with respect to the stacked structure of coins while the latter is introduced into the working space or while it is held by means of the wrapping rollers 17, 18 and 19 (it should be noted that there is no timing restriction with respect to the time when detecting is effected, although thing is different in case of detecting the cut-off of the wrapping paper.), a detecting signal 223*p* is inputted into the packing control circuit 214. Further, it is inputted into the wrapping roller clutch 217 from the sequence controller 215 while the signal 214*r* is inputted into the sequence controller 215 from the packaging control circuit 214. As a result transmission of rotation of the wrapping rollers 17, 18 and 19 is interrupted and thereby the signal 215*s* fails to be inputted into the wrapping paper feeding control circuit 221 from the sequence controller 215 whereby the pulse motor 222 is inhibited from starting of its rotation.

Since the packaging motor 218 continues its rotation irrespective of whether any wrapping paper cut-off abnormality and/or stacked structure abnormality is detected or not, the cam shaft 14 in the displacement mechanism 219 continues its rotation. The twisting hooks 23 are displaced into the space between the adjacent wrapping rollers while the wrapping paper is wound round the outer cylindrical surface of the stacked structure of coins. Then, one of them is raised up the elevated position and the other one is lowered to the lowermost position so that both the upper and lower end parts of the wound wrapping paper are folded while they are twisted. At the time when the above folding operation is initiated cutting operation of the wrapping paper is carried out with the aid of the cutting knife 30. While the folding operation is carried out, the holding rod 16 is disengaged from the lower face of the stacked structure of coins in the downward direction and it is then displaced sideward therefrom until the initial position is resumed. On completion of the folding operation the twisting hooks 23 are parted away from one another in the vertical direction and they are then displaced sideward until they are restored to the initial position. At this moment a signal is inputted into the packaging roller clutch 217 from the sequence controller 215 and thereby the wrapping roller clutch 217 becomes disengaged. As a result transmission of rotation of the wrapping rollers 17, 18 and 19 caused by the packaging motor 218 is interrupted and they stop their rotation while they are holding the wrapped structure of coins. At this moment they are caused to move in the outward direction until they are restored to the initial position.

On the other hand, the wrapping paper retaining roller 47 and the movable wrapping paper guide 36 resume their original position by actuating the displacement mechanism at a predetermined time after the wrapping paper is cut off by means of the cutting knife 30.

When the wrapping paper cut-off detection timing signal 215*t* is inputted into the packaging control circuit 214 from the sequence controller 215 while a signal is inputted into the same from the wrapping paper cut-off detecting switch 224, the wrapping paper feed timing signal 215*s* is inputted into the wrapping paper feeding control circuit 221 from the sequence controller 215 via the packaging control circuit 214 at the time when the wrapping paper cut-off detection timing signal 215*s* fails to be inputted (and the wrapping paper retaining roller 47 and the movable wrapping paper guide 36 resume the initial position). (It should be noted that if the wrapping paper cut-off detecting switch 224 fails to detect cut-off of the wrapping paper when the wrapping paper cut-off timing signal 215*s* is inputted, the packaging control circuit 214 becomes effective in preventing the wrapping paper feed timing signal 215*s* from being inputted into the wrapping paper feeding control circuit 221 from the sequence controller 215 and consequently the pulse motor 222 is inhibited from rotation during the packaging cycle.) As a result a predetermined number of pulses issued from the wrapping paper feeding control circuit 221 (a constant number of pulses irrespective of the kind of coins to be packaged) are applied to the pulse motor 222 whereby the wrapping paper feeding roller 27 is rotated and thereby the leading end part of the wrapping paper moves from the position located by the side of the cutting knife 30 to the position located by the side of the wrapping roller 18. It is then stopped at the last mentioned position. (It should be noted that the arrival of the leading end part of the wrapping paper at the position located by the wrapping roller 18 is achieved immediately after the latter is restored to the outermost position.) At this moment the pulse motor 222 comes to a stop. The cam shaft 14 in the displacement mechanism 219 resumes the initial operative position immediately after the stoppage of the pulse motor 222.

On the other hand, a counting start timing signal 215*u* is inputted into the packaging control circuit 214 from the sequence controller 215 at the time when the bottom plates 13 disposed at the lower end of the coin receiving sleeve 12 are displaced toward one another to close the coin passage. As a result a counting start timing signal 214*q* is inputted into the coin feeding control circuit 206 from the packaging control circuit 214 whereby the coin supply motor 207 and the counting motor 208 are caused to rotate. Now the next operation for counting and stacking the predetermined number of coins to be packaged is ready to start.

When the predetermined number of coins are counted and stacked, a coincidence detecting signal 205*p* is inputted into the packaging control circuit 214 from the coincidence circuit 214. If the cam shaft 14 in the displacement mechanism 219 does not resume the start position at the time the coincidence detecting signal 205*p* is inputted thereinto, a start position signal 215*v* is inputted into the packaging control circuit 214 from the sequence controller 215 when the start position is resumed later. However, due to the fact that the coincidence detecting signal 205*p* has been inputted into the packaging control circuit 214 a packaging start timing signal 214*p* is inputted into the sequence controller 215 from the packaging control circuit 214 and thereby the packaging motor 218 is caused to start its operation whereby the next packaging cycle continues to be practiced. Further, if the coincidence detecting signal 205*p* is still not inputted into the packaging control circuit 214 when a start position signal 215*v* is inputted into the latter, the packaging start timing signal 214*p* fails to be inputted into the sequence controller 215 from the packaging control circuit 214 whereby the packaging motor 218 comes to a stop and the cam shaft 14 in the displacement mechanism 219 is also stopped at the start position. When the coincidence detecting signal 205*p* is inputted into the packaging control circuit 214, the packaging motor 218 is caused to rotate again and thereby the next packaging cycle is started.

It should be noted that the parts and members in the coin packaging machine can be stopped at their present position respectively by actuating the stop switch 213 by way of push button operation when the intended processing has been completed or while the packaging cycle is still going or when there is a necessity for stopping the coin packaging machine during the counting operation of coins to be packaged while the packaging cycle is located still at its start.

Figure 4:
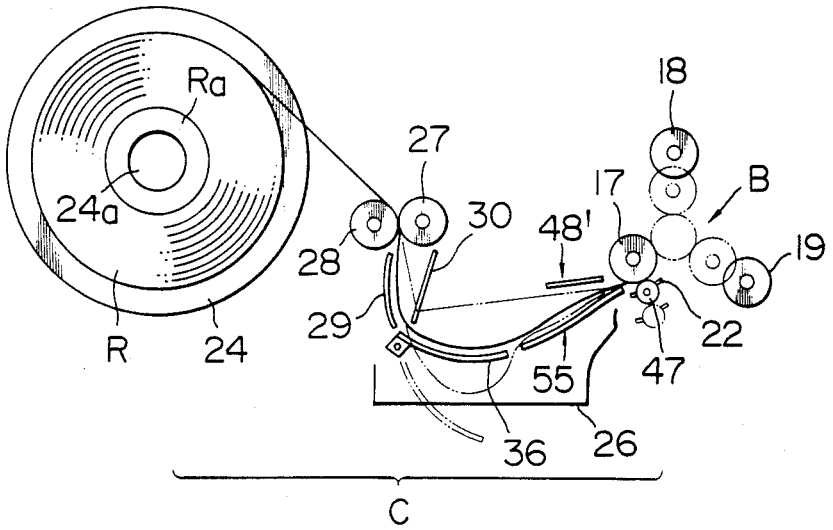

Next, a wrapping paper feeding device in accordance with the second embodiment of the present invention will be described below with reference to FIG. 4. In this connection it should be noted that the same or similar parts and members to those in the first embodiment as described above are identified with the same reference numerals and thus only those different from the latter will be described.

In the illustrated embodiment, among the wrapping rollers the wrapping roller 17 is designed to be stationary, whereas the wrapping rollers 18 and 19 are designed to be movable. The wrapping paper retaining roller 47 is disposed displaceably relative to the wrapping roller 17 and a wrapping paper guide 22 is fixedly secured to arm (not shown) by means of which the wrapping paper retaining roller 47 is rotatably held. Further, another wrapping paper guide 48′ is fixedly provided.

In case of the second embodiment the leading end part of the wrapping paper cut off by means of the cutting knife 30 is delivered to the movable wrapping paper guide 36 located at the position as identified with real lines in the drawing by way of rotation of the wrapping paper feeding rollers 27 and 28 by the predetermined angle of rotation and further it reaches the position located by the side of the wrapping roller 17 while it is guided by means of the second wrapping paper guide 55. After it has reached the last mentioned position it comes to a stop. At this moment the wrapping paper retaining roller 47 is located at the position as represented by a chain line in the drawing and it is then displaced toward the wrapping roller 17 in the same timing relation as the first embodiment so as to come in pressure contact with the leading end part of the wrapping paper whereby the latter is thrusted at the position located by the side of the wrapping roller 17 where the stacked structure of coins is held by means of the wrapping rollers.

On the other hand, the wrapping paper feeding rollers 27 and 28 are rotated by the required angle of rotation again, while the movable wrapping paper guide 36 is turned to the opened position as represented by chain lines in the drawing. Thus, the wrapping paper is delivered into the widened space defined by the opened wrapping paper guide 36 in such a configuration as represented by a chain line and it is then kept stopped when the wrapping paper feeding rollers 27 and 28 stop their rotation.

As a stacked structure of coins is introduced into the working space in the packaging mechanism, the wrapping rollers 18 and 19 are displaced from the position as represented by real lines to that by chain lines until it is held by the wrapping rollers 17, 18 and 19. As they start their rotation, the leading end part of the wrapping paper is delivered into the clearance between the wrapping roller 17 and the stacked structure of coins and it is then wound round the outer cylindrical surface of the latter, while the rear part of the wrapping paper is stretched in thrust contact with the cutting knife 30 in such a configuration as represented by a chain line in the drawing until it is cut off by means of the cutting edges of the cutting knife 30. In the meanwhile, the wrapping paper retaining roller 47 is thrusted against the wrapping roller 17 and thereby the former is driven by the latter as a follower roller so as to assist in feeding the wrapping paper.

After completion of the wrapping of the stacked structure of coins with the wrapping paper the wrapping paper retaining roller 47 is restored to the position as represented by the real line, while the movable wrapping paper guide 36 is restored to the closed position as represented by the real lines. As the wrapping paper feeding rollers 27 and 28 start their rotation, the next length of wrapping paper is delivered from the position located by the cutting knife 30 to that by the wrapping roller 17.

As will be readily apparent from the above description, the wrapping paper retaining roller 47 and the wrapping roller 17 function as a retaining mechanism constituting an essential part of the wrapping paper feeding device of the invention. It should be noted that the wrapping paper retaining roller 47 functions also as a wrapping paper feeding means constituting another essential part of the device.

Figure 5:
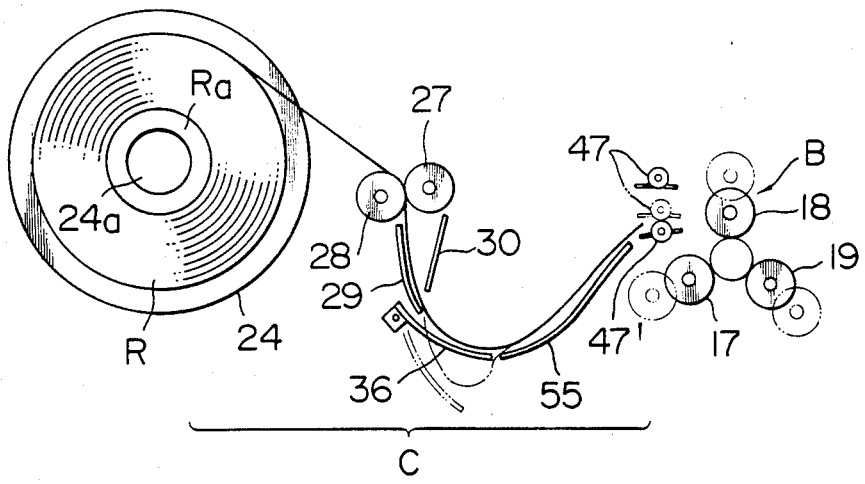

Next, a wrapping paper feeding device in accordance with the third embodiment of the present invention will be described below with reference to FIG. 5.

In the illustrated embodiment, a wrapping paper retaining roller 47 and a wrapping paper driving roller 47′ are disposed in the proximity of the wrapping rollers 17, 18 and 19 and the wrapping paper driving roller 47′ is designed in such a manner that it has the same peripheral speed as that of the wrapping rollers 17, 18 and 19 and it starts and stops its rotation in the same timing relation as that of the latter.

In case of the second embodiment, the leading end part of the wrapping paper is delivered to the position located by the side of the wrapping paper driving roller 47′, while both the movable wrapping paper guide 36 and the wrapping paper retaining roller 47 are located at the position as represented by real lines in the drawing. Thereafter, the wrapping paper retaining roller 47 and the movable wrapping paper guide 36 are displaced to the position as represented by chain lines and the wrapping paper is then drawn into the holding space as represented by a chain line in the drawing by driving the wrapping paper feeding rollers 27 and 28. After the latter comes to a stop the wrapping paper is delivered into the clearance between the wrapping roller 18 and the stacked structure of coins by rotating the wrapping paper driving roller 47′ and it is then wound round the outer cylindrical surface of the stacked structure of coins.

In the second embodiment, the wrapping paper retaining roller 47, the wrapping paper driving roller 47′ and the wrapping rollers 17, 18 and 19 function as a wrapping paper feeding means constituting an essential part of the wrapping paper feeding device of the invention, whereas the wrapping paper retaining roller 47 and the wrapping paper driving roller 47' function as a wrapping paper retaining means constituting another essential part of the device.

Next, a wrapping paper feeding paper in accordance with the fourth embodiment of the present invention will be described below with reference to FIGS. 6(A) and 6(B).

This embodiment is intended to be applied to a coin packaging machine of the type which is constructed such that a wrapping paper roll R is rotatably held on a wrapping paper storing section 102 detachably fitted into a shelf plate 101 which is radially extended from a pivotal shaft 100 and any selected wrapping paper roll having a different width is located at a correct wrapping paper feeding position. It should be noted that differences of the fourth embodiment from the first one consist in that the upright standing support shaft 37 for the movable wrapping paper guide 36 is positioned to the right as seen in the drawings so as to allow the left part of the latter located adjacent to the wrapping paper roll R to be turned in the anticlockwise direction and moreover a rewinding mechanism is provided for the wrapping paper roll R in order to ensure that a certain length of wrapping paper drawn out therefrom is rewound when selecting the mounting position of the wrapping paper roll R by turning the pivotal shaft 100.

The wrapping paper storing section 102 includes a base plate 103 which is detachably fitted to the shelf plate 101 with the aid of suitable guide means radially extending from the outermost end of the shelf plate 101 and can be locked using a locking means (not shown).

The holding rod 24*a* stands upright at the central part of the base plate 103 and the roll core Ra of the wrapping paper roll R is loosely fitted onto the holding rod 24*a* so as to rotatably hold the wrapping paper roll R.

Further, a support column 24*b* stands upright at the lower left corner of the base plate 103 as seen in the drawing and a retaining rod 24*c* is disposed pivotally at the top end of the support column 24*b* so as to depress the upper surface of the wrapping paper roll R at its free end under resilient force of a coil spring (not shown). Thus, there is no fear that the wrapping paper roll R falls down during the pivotal movement of the shaft 100.

A thrust roller 104 is disposed in such a manner as to come in pressure contact with the outer cylindrical surface of the wrapping paper roll R. Specifically, the thrust roller 104 is held rotatably about a shaft 115 disposed at the free end of an arm 106 which is in turn held pivotally about a shaft 107 standing upright on the base plate 103, and arm 106 is adapted to urge the thrust roller 104 to come in pressure contact with the outer surface of the wrapping paper roll R under resilient force of a coil spring 105.

Further, a wrapping paper feeding roller 28 is rotatably fitted onto the shaft 107 and a pulley 108 is fixedly secured to the wrapping paper feeding roller 28, and the pulley 108 is located between the arm 106 and the wrapping paper feeding roller 28. As is apparent from the drawing, the arm 106 has a bent portion in an inverted V-shape through which a shaft 109 is extended so as to carry a pulley 110 and a gear 111 thereon which are fixed to one another. An endless belt 112 is bridged between both the pulleys 108 and 110 and another gear 113 rotatably held on the shaft 115 meshes with said gear 111.

Reference numerals 117 and 118 designate a wrapping paper guide respectively which is fixedly mounted on the base plate 103 so as to guide the strip of wrapping paper to the movable wrapping paper guide 36. The wrapping paper storing section 102 is constructed in the above-described manner.

A wrapping paper feeding roller 27 is rotatably held at the free end of a lever 120 which is mounted pivotally about an upright standing shaft 119 located at the stationary side of the coin packaging machine. A plunger 122*a* of a solenoid 122 is operatively connected to the lever 120 by way of a pin 121 disposed at the middle part of the lever 120 so that the wrapping paper feeding roller 27 is displaced to the position as represented by a chain line in the drawing by magnetizing the solenoid 122 and it is displaced to that by a real line under resilient force of a spring means incorporated in the solenoid 122 by demagnetized the latter so as to come in pressure contact with the wrapping paper feeding roller 28. The wrapping paper feeding roller 27 functions as a driving roller. Specifically, rotation of a pulse motor (as identified with reference numeral 222 in FIG. 9) operatively connected to the support shaft 119 is transmitted to the wrapping paper feeding roller 27 via a series of gears (not shown).

The cutting knife 30 and the leaf spring 32 are mounted also at the stationary side of the coin packaging machine and other parts and members are constructed in the substantially same manner as in case of the first embodiment except that the wrapping paper feeding roller 27 is rotated in the opposite direction as required in addition to the fact that it is normally rotated in a predetermined timing relation.

A door 124 is openably mounted on a casing cover 123 of the coin packaging machine with the aid of a hinge 124*a* located at the left side of the wrapping paper storing section 102 and a door switch 126 is fixedly mounted on another casing cover 125 so as to detect opening and closing operations of the door 124. When the opening operation of the latter is detected by means of the switch 126, the wrapping paper feeding roller 27 is caused to rotate by a predetermined angle of rotation in the opposite direction. It should be noted that the above angle of reverse rotation is determined in dependence on the length of the wrapping paper to be drawn back from the position located by the side of the wrapping roller 18 to that by the wrapping paper guide 117 when there is a necessity for changing the kind of coins to be packaged.

In case of the illustrated fourth embodiment, the wrapping paper feeding roller 27 is rotated in the opposite direction by the predetermined angle of rotation irrespective of any kind of coins to be packaged, once a certain kind of coins to be packaged is selected by actuating the knob 6. It should be noted that the leading end part of the wrapping paper is positioned by the side of the wrapping roller 18 prior to selecting the kind of coins in the same manner as in case of the first embodiment.

While the shaft 100 is turned, the wrapping paper feeding roller 27 assumed the position as represented by the chain line in the drawing with the solenoid 122 magnetized but when the base plate 103 in the wrapping paper storing section 102 has reached to a required plane located in parallel to the base plate 26 at the stationary side of the coin packaging machine, the solenoid 122 becomes demagnetized whereby the wrapping paper feeding roller 27 is displaced to the position as represented by the real line in the drawing until it comes in pressure contact with the wrapping paper feeding roller 28. As a result reverse rotation of the wrapping paper feeding roller 27 causes the wrapping paper to be drawn back in cooperation with the wrapping paper feeding roller 28.

Further, the reverse rotation of the wrapping paper feeding roller 28 is transmitted to the wrapping paper retaining roller 104 via the pulley 108, the endless belt 112, the pulley 110 and gears 111 and 113 so that the wrapping paper retaining roller 104 is rotated in the opposite direction. Since both the wrapping paper feeding roller 28 and the wrapping paper retaining roller 104 are dimensioned to have the same diameter, it is ensured that the wrapping paper is correctly rewound round the wrapping paper roll R by means of the wrapping paper feeding rollers 27 and 28. Thus, the leading end part of the wrapping paper is relocated along the guide surface of the wrapping paper guide 117 located by the side of the cutting knife 30 and when the wrapping paper is dislocated from the base plate 26 to the base plate 103, the wrapping paper feeding roller 27 stops its rotation and at the same time the wrapping paper feeding roller 28 and the wrapping paper retaining roller 104 become inoperative. Further, the wrapping paper feeding paper 27 is then displaced to the position as represented by the chain line when the solenoid 122 is magnetized.

At this moment a movable frame actuating motor (as identified with reference numeral 227 in FIG. 9) starts its rotation so that the shaft 100 is turned until the base plate 103 in the wrapping paper storing section 102 assumes the position corresponding to the required kind of coins to be packaged relative to the base plate 26 and then the movable frame actuating motor comes to a stop. Thereafter, the solenoid 122 becomes demagnetized and thereby the wrapping paper feeding roller 27 is brought in pressure contact with the wrapping paper feeding roller 28. As soon as the above pressure contact is achieved, the wrapping paper feeding roller 27 is caused to rotate in the normal direction by the same angle of rotation as that of the above reverse rotation. As a result the wrapping paper is forwarded to the position located by the side of the wrapping roller 18 from the guide surface of the wrapping paper guide 117 located by the side of the cutting knife 30.

Next, when the start switch (as identified with reference numeral 212 in FIG. 8) is actuated by way of push button operation and thereby counting operation is initiated, a predetermined number of coins are stacked one above another in the coin receiving sleeve 12. On completion of the predetermined number of coin stackings the counting device 10 generates a counting completion signal (packaging starting signal) and thereby the cam shaft 14 starts its rotation, causing the wrapping paper retaining roller 47 to become effective in thrusting the wrapping paper against the wrapping paper guide 55 at its predetermined position by way of actuation of the cam 53. The movable wrapping paper guide 36 is then turned from the position as represented by real lines in the drawing to that by chain lines.

At this moment the wrapping paper feeding roller 27 starts its rotation. A group of wrapping papers are classified into three groups in dependence on an outer diameter of coins to be packaged, that is, those for group of coins of large size of diameter, those of medium size of diameter and those of small size of diameter. In case of the group of coins of large size of diameter the wrapping paper feeding roller 27 is rotated by the predetermined angle of rotation, in case of the group of medium size of diameter it is rotated by a less angle of rotation than the foregoing one and in case of the group it is not rotated any longer. The illustrated wrapping paper feeding device is designed for the kind of coins of medium size of diameter and the wrapping paper feeding rollers 27 and 28 and the wrapping paper retaining roller 104 are caused to stop when the wrapping paper is drawn out to the position as represented by the chain line in the drawing. Next, a stacked structure of coins is introduced into the working space defined by the wrapping rollers 17, 18 and 19. As they start their rotation while they hold the stacked structure of coins, the wrapping paper is wound round the latter and thereby it is kept in a stretched state until it is cut off by means of the cutting knife 30.

At this moment the wrapping paper retaining roller 47 and the movable wrapping paper guide 36 are restored to the position as represented by the real lines in the drawing and the wrapping paper feeding rollers 27 and 28 and the wrapping paper retaining roller 104 are driven by a predetermined angle of rotation while wrapping operation is carried out in the packaging mechanism whereby a next length of wrapping paper is delivered from the position located by the side of the cutting knife 30 toward that by the wrapping roller 18. When the wound structure of coins is discharged from the working space defined by the wrapping rollers 17, 18 and 19, the leading end part of the wrapping paper reaches the position located by the side of the wrapping paper 18 and then the wrapping paper feeding rollers 27 and 28 and the wrapping paper retaining roller 104 stop their rotation, resulting in interruption of feeding of the wrapping paper. Immediately after their operation is stopped, the cam shaft 14 is restored to the starting position whereby a cycle of packaging operations are completed.

It should be noted that in case of a wrapping paper for coins belonging to the group of large size of diameter the wrapping paper is drawn out in such a configuration as represented by two-dot chain lines with the movable wrapping paper guide 36 kept opened, whereas in case of that for coins belonging to the group of small size of diameter no additional feeding is effected and the drawn wrapping paper assumes the position as represented by the real lines in the drawing.

When the wrapping paper roll R becomes empty, the door 124 is opened and the opening operation of the door 124 is detected by means of the door switch 126 whereby the wrapping paper feeding roller 27 is caused to rotate in the opposite direction by the predetermined angle of rotation. As a result the leading end part of the wrapping paper which has been already drawn out to the position located by the side of the wrapping roller 18 via the wrapping paper feeding passage including the wrapping paper guide 117 is brought back to the position located midway of the wrapping paper guide 117 or the position located behind the wrapping paper feeding rollers 27 and 28. Then, the locking mechanism is disconnected and thereafter the base plate 103 is pulled forward of the shelf plate 101. Now the wrapping paper storing section 102 is ready to be disengaged from the shelf plate 101.

After removal of the wrapping paper storing section 102 the retaining rod 24*c* is turned upward so that the roll core Ra is removed from the holding rod 24*a*. Then, a new wrapping paper roll R is placed on the base plate 103 by fitting the roll core Ra thereof onto the holding rod 24*a* and thereafter the retaining rod 24*c* is turned downward until it comes in contact with the upper end surface of the wrapping paper roll R. Further, the wrapping paper retaining roller 104 which has been displaced in the vicinity of the holding rod 24*a* is displaced backward against resilient force imparted by the coil spring 105 due to contact with the outer cylindrical surface of the new wrapping paper roll R.

Next, the leading end part of the wrapping paper adhesively secured to the outer cylindrical surface of the new wrapping paper roll R is manually peeled off therefrom and it is then caused to pass by the wrapping paper retaining roller and the wrapping paper feeding roller 28. Further, it passes through the clearance between both the wrapping paper feeding rollers 117 and 118 and comes to a stop at the position located a little past the latter.

Prior to fitting the wrapping paper storing section 102 to the shelf plate the movable wrapping paper guide 36 is turned open to the position as represented by the chain lines in the drawing. Then, the wrapping paper storing section 102 is firmly engaged to the shelf plate and it is kept locked with the aid of the locking mechanism which is not shown in the drawing.

The leading end part of the wrapping paper is cut off to the V-shaped configuration by manually thrusting against the cutting knife 30 and thereafter the movable wrapping paper guide 36 is released from the opened state so as to resume the position as represented by the real lines in the drawing.

The door 124 is closed and the closing operation of the door 124 is detected by means of the door switch 126 whereby the wrapping paper feeding roller 27 is caused to rotate in the normal direction by the predetermined angle of rotation until the leading end part of the wrapping paper is forwarded to the position located by the side of the wrapping roller 18.

The subsequent packaging operations are quitely same to those in the foregoing embodiments and thus their repeated description will be not required. It should be noted that the wrapping paper feeding roller 27 is normally located at the position as represented by the real line in the drawing except when the pivotal shaft 100 starts its turning operation and while it is turned.

In the illustrated fourth embodiment, just one set of cutting knife 30 is disposed at the stationary side of the coin packaging machine. Alternatively, one set of cutting knife may be provided corresponding to every kind of coins to be packed using a specific wrapping paper roll R. For instance, a cutting knife 30 may be fixedly mounted at the position located by the side of the wrapping paper guide 118 on the base plate 103 which is selected to the kind of coins to be packaged. The last mentioned arrangement has an advantage that the leading end part of the wrapping paper can be cut off to the V-shaped configuration by thrusting it against the cutting knife prior to placing a new wrapping paper roll R on the wrapping paper storing section 102 while the door 124 is kept opened and the wrapping paper storing section 102 is disengaged from the shelf plate 101 and therefore the above-mentioned cutting operation is not required any longer which is carried out with the movable wrapping paper guide 36 kept opened.

If the wrapping paper fails to be cut off during the packaging operation for any reason, the detecting piece 35*a* is still kept inoperative and therefore the detecting switch SW (as identified with reference numeral 224 in FIG. 8) is not actuated. The first and fourth embodiments are constructed such that once a malfunction takes place in that way, the wrapping paper feeding roller 27 and the wrapping rollers 17, 18 and 19 are caused to stop their rotation and the wrapping rollers 17, 18 and 19, the twisting hooks 23 and the holding rod 24*a* resume the starting position to stop their operation after their displacement and operation continue by the distance corresponding to one cycle of packaging operations. Alternatively, the wrapping paper feeding roller 27 may be rotated in the opposite direction by the predetermined angle of rotation until the leading end part of the wrapping paper is drawn back to the position in proximity of the cutting knife 30.

Next, FIG. 9 schematically illustrates by way of a block diagram the wrapping paper feeding section 500 together with the knob 6 for determining the kind of coins to be packaged and a part of the operation control section 400 each of which is used for the wrapping paper feeding device in accordance with the fourth embodiment. The fourth embodiment is quitely same to the first embodiment with respect to control operations during the packaging operation but the former is different from the latter only with respect to operations during the selection of the kind of coins to be packaged. Specifically, as is readily apparent from a comparison with FIG. 8, a solenoid 122, a movable frame turning operation control circuit 226 and a movable frame turning motor 227 are additionally provided for the fourth embodiment. Further, a door switch 126 is used in place of the wrapping paper set switch 225. It should be noted that the movable frame is constructed of a combination of the pivotal shaft 100 and the shelf plate 101 extending radially from the former both of which are illustrated in FIG. 6. The subsequent description will be made below using the designation of the aforesaid movable frame.

When the knob 6 for determining the kind of coins to be packaged is actuated, the movable frame turning operation control circuit 226 is preset corresponding to the selected kind of coins. A signal is then inputted into the wrapping paper feeding control circuit 221 from the movable frame turning operation control circuit 226 and a predetermined number of pulses are applied to a pulse motor 222 whereby the latter is caused to rotate in the opposite direction and at the same time the wrapping paper feeding roller 27 is also caused to rotate in the opposite direction. As a result the wrapping paper is drawn back to the position located by the side of the wrapping paper guide 117 as illustrated in FIG. 6 (within the scope defined by the movable frame). At this moment the wrapping paper feeding control circuit 221 becomes effective in magnetizing the solenoid 122 which in turn draws the wrapping paper feeding roller 27 toward the stationary side of the coin packaging machine (located outside the movable frame). At the same time a signal is inputted into the movable frame turning operation control circuit 226 from the wrapping paper feeding control circuit 221 and thereby the movable frame turning motor 227 is driven by a predetermined angle of rotation with the result that the movable frame is turned by a predetermined angle of rotation until the wrapping paper storing section 102 assumes a specific wrapping paper feeding position corresponding to the selected kind of coins to be packaged. At this moment the wrapping paper feeding control circuit 221 becomes effective in deenergizing the solenoid 122 and thereby the wrapping paper feeding roller 27 is brought in contact with the wrapping paper feeding roller 28. At this moment a signal is inputted into the wrapping paper feeding control circuit 221 from the movable frame turning operation control circuit 226 and a predetermined number of pulses are then applied to the pulse motor 222 from the wrapping paper feeding control circuit 221 so as to ensure rotation of the former in the normal direction. Thus, the wrapping paper feeding roller 27 is rotated by the predetermined angle of rotation until the wrapping paper is forwarded to the position located by the side of the wrapping roller 18. The subsequent wrapping operations are quitely same to those in the first embodiment.

Next, exchanging operation of the wrapping paper will be described below with reference to FIG. 6. When the door 124 is opened, the door switch 126 is switched over and thereby a predetermined number of pulses are applied to the pulse motor 222 in order to ensure that the wrapping paper feeding roller 27 is rotated in the opposite direction by the predetermined angle of rotation. As a result the leading end part of the wrapping paper is drawn back to the position located within the wrapping paper storing section 102 (see FIG. 6). Then, the whole wrapping paper storing section 102 is disengaged from the coin packaging machine and after it is equipped with a new wrapping paper roll it is engaged to the coin packaging machine again. Thereafter, the leading end part of the wrapping paper is formed to the V-shaped configuration by thrusting it against the cutting knife 30 with the movable wrapping paper guide 36 kept opened. Next, when the movable wrapping paper guide 36 is turned to the closed position and at the same time the door 124 is closed, the door switch 126 is switched over and thereby the predetermined number of pulses are applied to the pulse motor 222 from the wrapping paper feeding control circuit 221 so as to ensure rotation of the former in the normal direction whereby the same is rotated in the normal direction and the wrapping paper feeding roller 27 is driven in the normal direction by the predetermined angle of rotation. As a result the leading end part of the wrapping paper is forwarded from the position located by the side of the cutting knife 30 to that by the wrapping roller 18 and then it comes to a stop. Thus, preparative works have been completed for packaging operation and the latter is ready to be initiated at any time.

Figure 7A:
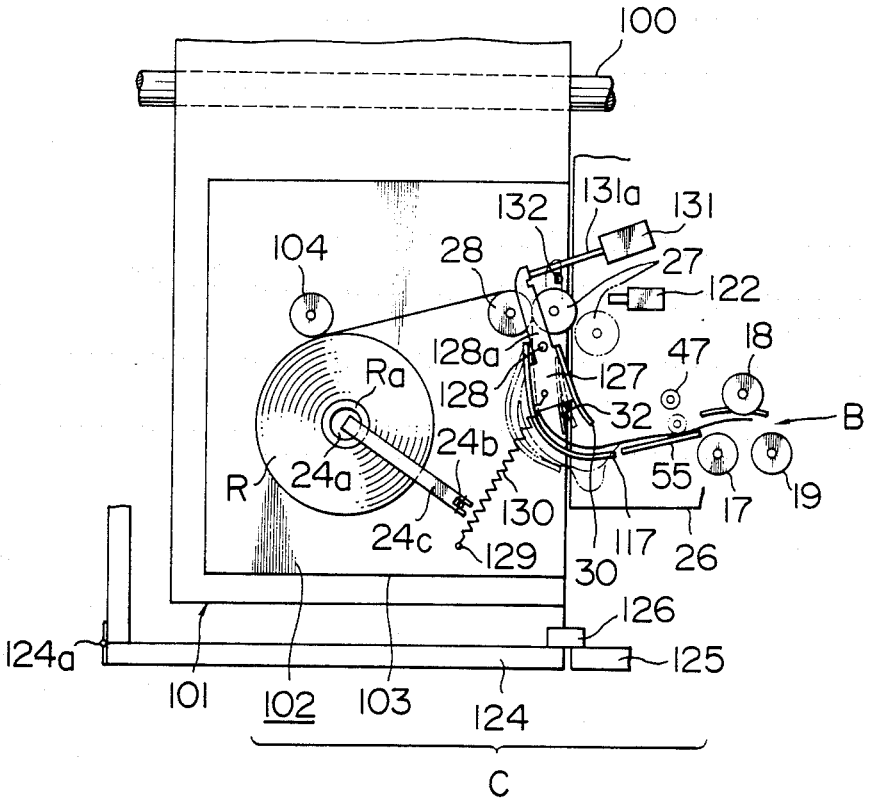
FIG. 7(A) is a schematic plan view of the wrapping paper feeding device in accordance with the fifth embodiment of the invention.
Figure 7B:
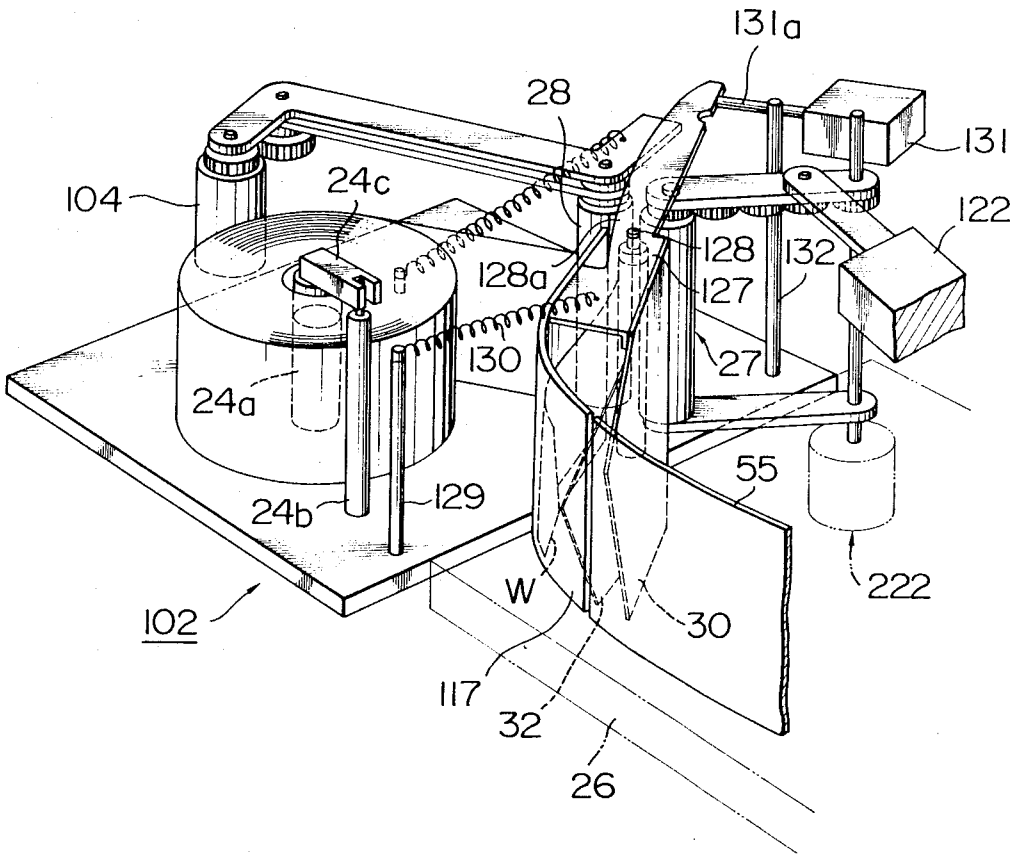
FIG. 7(B) is a perspective view of essential parts of the wrapping paper feeding device in FIG. 7(A), shown in an appreciably larger scale.

Next, a wrapping paper feeding device in accordance with the fifth embodiment of the present invention will be described below with reference to FIGS. 7(A) and 7(B).

Figure 6A:
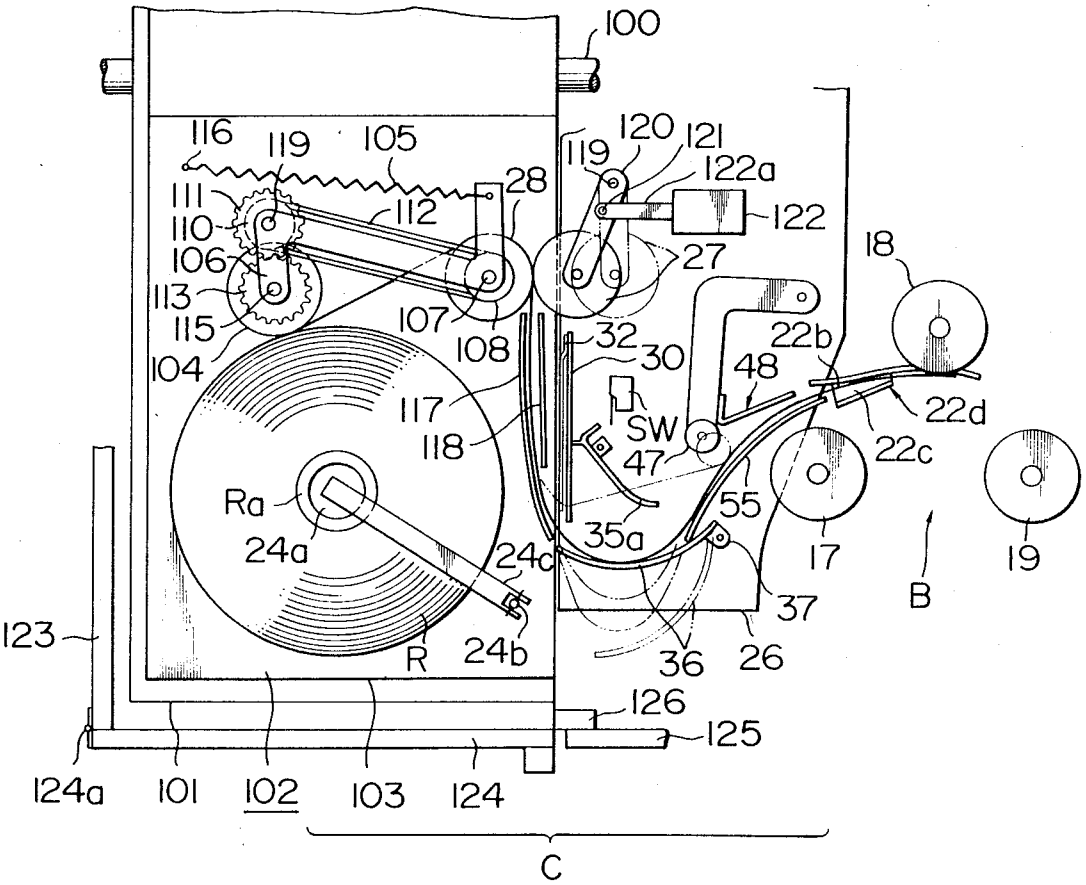
FIG. 6(A) is a schematic plan view of the wrapping paper feeding device in accordance with the fourth embodiment of the invention.
Figure 6B:
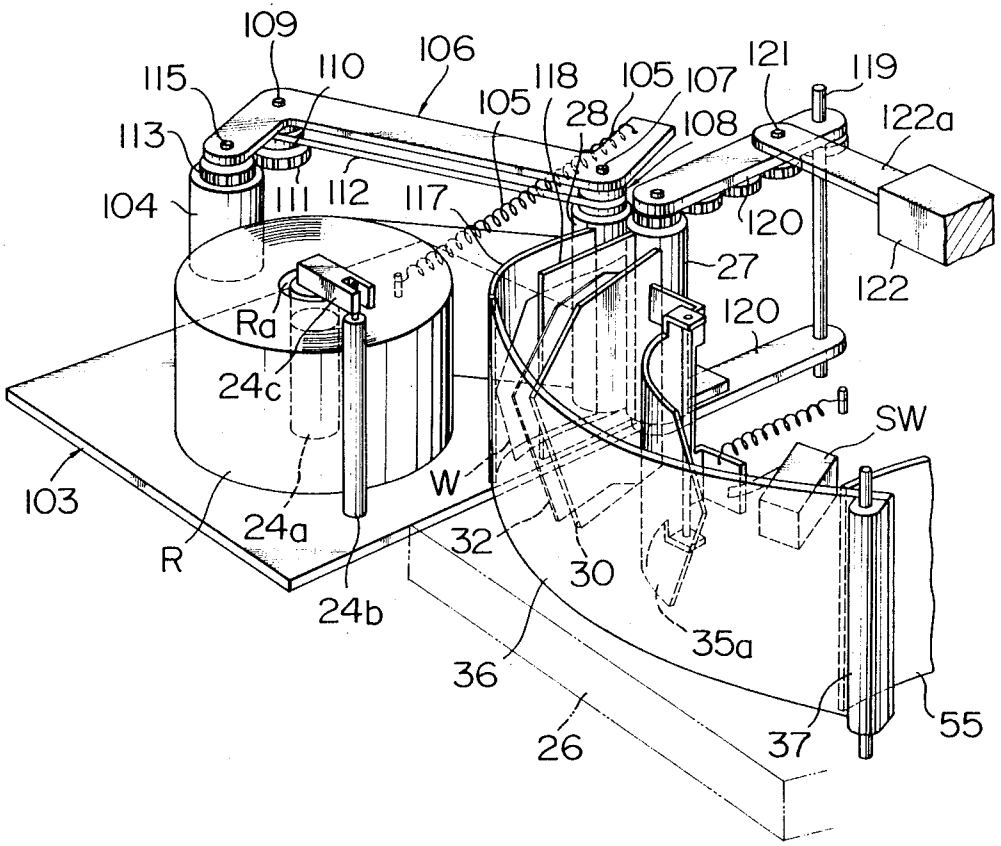
FIG. 6(B) is a perspective view of essential parts of the wrapping paper feeding device in FIG. 6(A)

A difference of the fifth embodiment from the fourth embodiment (as illustrated in FIGS. 6(A) and (B)) consists in the structure of a wrapping paper guide 117 and a cutting knife 30.

Specifically, the wrapping paper guide 117 and the cutting knife 30 are fixedly secured to an arm lever 127 while they are spaced from one another with a predetermined distance kept therebetween, and the arm lever 127 is pivotally held at its central part by means of a support shaft 128 standing upright on the base plate 103 so that it is turned in a horizontal plane.

The support shaft 128 includes a roller **128*a* loosely fitted thereto which serves to keep a predetermined distance between the support shaft 128 and the wrapping paper guide 117. The roller 128*a* functions as a retainer for the purpose of preventing the wrapping paper from becoming loosened when the wrapping paper feeding roller 27** is displaced to the inoperative position.

Between the part of the arm lever 127 where the wrapping paper guide 117 is fixedly secured to the latter and a pin 129 standing upright on the base plate 103 is bridged a tension spring 130 in the form of a coil spring having a high intensity of resilient force. To ensure that the wrapping paper is thrusted against the cutting knife 30 located at the position as represented by chain lines in the drawing under the resilient force imparted by the coil spring 130 when cutting the wrapping paper the coil spring 130 is designed to have a sufficiently high intensity of resilient force by means of which the cutting knife 30 is held at the position as represented by the chain lines.

Further, the arm lever 127 is designed such that a plunger **131*a* of a solenoid 131 abuts against the upper end of the arm lever 127 as seen in the drawing. When the solenoid 131 is magnetized and the arm lever 127 is turned in the counterclockwise direction by means of the plunger 131*a*, both the cutting knife 30 and the wrapping paper guide 117 assume the position as represented by real lines in the drawing respectively. On the other hand, when the solenoid 131 becomes demagnetized, the plunger 131*a* is retracted until it is displaced outward of the area defined by the base plate 103. Thus, any interference does not take place between the base plate 103 and the plunger 131*a* when the pivotal shaft 100** is turned.

As the plunger **131*a* moves back, the arm lever 127 is turned about the support shaft 128 in the clockwise direction under the resilient force of the coil spring 130 and when it abuts against a stopper pin 132 standing upright on the base plate 132 it comes to a stop. At this moment the cutting knife 30 and the wrapping paper guide 117** resume the position as represented by the chain lines in the drawing respectively.

Next, operations for selecting the kind of wrapping paper and feeding the same will be described below.

In the illustrated fifth embodiment, the subsequent length of the wrapping paper is by no means forwarded during the packaging cycle, after cutting operation is carried out by means of the cutting knife 30. The first to fourth embodiments as described above are practiced such that while a stacked structure of coins is packaged using the cut length of the wrapping paper the subsequent part of the same is forwarded and when the wrapped structure of coins is discharged from the working space it reaches the position located by the side of the wrapping roller 17 or 18 (the wrapping paper driving roller 47' in case of the third embodiment). Thus, it can be concluded that their employment is preferable from a viewpoint of the timing relation among displacement of the wrapping rollers, movement of the stacked structure holding rod and others in the packaging mechanism. However, if there is a necessity for changing the kind of wrapping paper corresponding to the changed kind of coins to be packaged, replacement of the existing wrapping paper roll R with a new one cannot be effected unless the leading end part of the wrapping paper of the former which has been already delivered to the wrapping roller is drawn back from the area of the packaging mechanism. In view of the above drawback inherent to the foregoing embodiments, the fifth embodiment is intended to provide an improvement which consists in that just a length of wrapping paper required for the packaging cycle is forwarded downstream of the cutting knife 30 (toward the packaging mechanism).

For the above-mentioned reason the wrapping paper guide 117 and the cutting knife 30 are normally located at the position as represented by the chain lines in the respectively and the leading end part of the subsequent wrapping paper reaches the position in the proximity of the cutting knife 30. At this moment the solenoid 131 is demagnetized and thereby the plunger 131*a* thereof is disengaged from the arm lever 127 without any contact with the latter.

First, the knob 6 (see FIG. 1) is rotated so as to select the required kind of coins to be packaged and thereby the pivotal shaft 100 is turned by a predetermined angle of rotation. As a result the wrapping paper storing section 102 for the wrapping paper roll R corresponding to the selected kind of coins to be packaged assumes a correct position relative to the base plate 26 for the packaging mechanism. It should be noted that during the turning movement of the wrapping paper storing section 102 the wrapping paper feeding roller 27 is held at the position as represented by the chain lines in the drawing by magnetizing the solenoid 122 in the same manner as the preceding embodiment as illustrated in FIGS. 6(A) and 6(B) in order to ensure that no interference takes place between the wrapping paper storing section 102 and the wrapping paper feeding roller 27. Then, the start switch is actuated and the selected kind of coins are stacked one by one while counting the number of stacked coins. When the counting device 10 has counted the predetermined number of stacked coins, a counting operation completion signal (packaging operation start signal) is issued whereby the cam shaft 14 is caused to rotate. Immediately after the starting of rotation of the cam shaft 14 the solenoid 131 is energized and thereby the cutting knife 30 and the wrapping paper guide 117 are displaced to the position as represented by the real lines in the drawing. The wrapping paper feeding roller 27 is brought in pressure contact with the wrapping paper feeding roller 28 except when the shaft 100 is turned as well as when the door 124 is opened. After the above pressure contact is achieved the wrapping paper feeding roller 27 starts its rotation. As will be readily apparent, the period of rotation of the wrapping paper feeding roller 27 is different in dependence on the three kinds of coins to be packaged. Specifically, in case of coins belonging to the group of small size of diameter the above period of rotation is identical to a period of time that elapses until the leading end part of the wrapping paper reaches the position located by the side of the wrapping roller 18 while the wrapping paper guide 117 is kept closed. In case of coins belonging to the group of medium size of diameter it becomes appreciably longer than that of the small size of coins. Further, in case of coins belonging to the group of large size of diameter it becomes longer than that of the medium size of coins.

The leading end part of the wrapping paper is delivered from the position located by the side of the cutting knife 30 to that located by the wrapping roller 18 via the side wall of the wrapping paper guide 117. At this moment the wrapping paper retaining roller 47, the cutting knife 30 and the wrapping paper guide 117 are displaced to the position as represented by the chain lines in the drawing respectively. Specifically, the wrapping paper retaining roller 47 is displaced by actuating the cam 53 and the lever 41 as seen in FIG. 1, whereas the cutting knife 30 and the wrapping paper guide 117 are displaced merely by demagnetizing the solenoid 131 without any necessity for a lever means.

The above displacement is carried out after a predetermined period of time elapses since the starting of rotation of the wrapping paper feeding roller 27 and the leading end part of the wrapping paper reaches the position located by the side of the wrapping roller 18. In case that coins to be packaged have a small size of diameter, the wrapping paper feeding roller 27 is caused to stop its rotation when the aforesaid displacement is has been completed, whereas in case of coins having a medium or large size of diameter the wrapping paper feeding roller 27 continues to rotate by an angle of rotation corresponding to the selected size of diameter of coins to be packaged and then it comes to a stop. Thus, the wrapping paper for small size of coins is held in such a configuration as illustrated by the real lines in FIG. 7(B), that for medium size of coins is held in such a configuration as by the chain lines and that for large size of coins is held in such a configuration as by the two-dot chain lines in the drawing.

Thereafter, a stacked structure of coins introduced from the coin receiving sleeve 12 into the working space defined by the wrapping rollers 17, 18 and 19 is held by the latter and on completion of the firm holding of the stacked structure coins the wrapping rollers 17, 18 and 19 start their rotation whereby the wrapping paper is wound round the outer cylindrical surface of the stacked structure of coins and thereby it becomes stretched until it is cut off by allowing it to be thrusted against the cutting knife 30. After cutting is effected, the leading end part of the subsequent wrapping paper is urged toward the side wall of the wrapping paper guide 117 with the aid of the leaf spring 32 disposed by the side of the cutting knife 30 in a spaced relation. When the next packaging cycle is initiated, the solenoid 131 is magnetized and thereby the cutting knife 30 and the wrapping paper guide 117 are displaced to the operative position as represented by the real lines in the drawing in the same manner as in the foregoing. Then, the same operations as described above are repeated.

When the wrapping paper roll R becomes empty, the leading end part of the residual wrapping paper is located at the position located between the wrapping roller 18 and the cutting knife 30 (the position as represented by the chain line in the drawing).

As the door 124 is opened, the door switch 126 is actuated and thereby the wrapping paper feeding roller 27 is caused to rotate in the opposite direction by a predetermined angle of rotation while coming in contact with the wrapping paper feeding roller 28. The distance of the reverse movement of the wrapping paper is identical to the feeding length of the same in case of coins belonging to the group of small size of diameter.

Further, the leading end part of the residual wrapping paper is drawn back to the position located by the side of the wrapping paper guide 117 or the cutting knife 30 as represented by the chain lines in the drawing or to the position located between the wrapping paper feeding roller 28 and the wrapping paper retaining roller 104 disposed upstream the latter. At this moment the wrapping paper feeding roller 27 is displaced to the position as represented by the real line in the drawing.

Then, the wrapping paper storing section 102 is disconnected from the shelf plate 101 and the used roll core Ra is removed therefrom. A new wrapping paper roll R is placed on the base plate 103 by fitting its roll core Ra onto the holding rod 24a. After the leading end part of the wrapping paper adhesively secured to the outer surface of the new wrapping paper roll R is peeled off therefrom, it is caused to pass by the wrapping paper retaining roller 104 and the wrapping paper feeding roller 28 and further pass through the space between the cutting knife 30 and the wrapping paper guide 117. It is then cut off in the V-shaped configuration by thrusting it against the cutting knife 30. After completion of the cutting operation the wrapping paper is urged toward the side wall of the wrapping paper guide 117 under resilient force imparted by the leaf spring 32. The wrapping paper storing section 102 with the new wrapping paper roll R mounted thereon is fitted along the shelf plate 101 whereby the arrangement as illustrated in FIG. 7(B) is provided.

Next, the wrapping paper storing section 102 is locked and the door 124 is closed which is in turn detected by means of the door switch 126 whereby the solenoid 122 becomes demagnetized and the wrapping paper feeding roller 27 is restored to the operative position as represented by the real line from the inoperative position as represented by the chain line in the drawing. Since the wrapping paper feeding roller 27 is still not rotated, the leading end part of the wrapping paper continues to be positioned in the proximity of the wrapping paper guide 117 disposed by the side of the cutting knife 30. Now the wrapping paper is ready to be forwarded for the next packaging cycle.

It should be of course understood that the present invention should be not limited only to the first to fifth embodiments and various changes or modifications may be made without any departure from the spirit and scope of the invention, for instance, a wrapping paper storing section employed for the device in accordance with the fourth and fifth embodiments may be applied to the first to third embodiments.

Further, all the embodiments have been described with the respect to the wrapping rollers 27 and 28 which are designed in the form of a simple roller but they may be replaced with a pair of endless belts or a combination of an endless belt and a roller. In the above embodiments a pulse motor is employed as a driving power source but the present invention should be not limited only to this but other type of motor may be used. Further, a motor for driving the wrapping rollers may be continuously driven during the whole packaging cycle. In this case clutching mechanisms are disposed between the motor and the wrapping paper feeding roller 27 as well as between the former and the three wrapping rollers 17, 18 and 19 so that their rotation and stoppage are initiated by actuating the clutching mechanisms.

In the above-described embodiments an angle of rotation of the wrapping paper feeding roller 27 is changed by way of elongating or shortening the duration of rotation. Alternatively, it may be changed by way of increasing or decreasing a rotational speed of the wrapping paper feeding roller 27 within a predetermined period of time which is kept constant irrespective of any selected kind of coins to be packaged.

Further, in the above-described embodiments a length of wrapping paper required for a wrapping operation is determined separately for the three kinds of coin size, that is, small size of diameter, medium size of diameter and large size of diameter. Alternatively, it may be determined in dependence on the kind of coins to be packaged.

Further, the wrapping paper retaining mechanism is designed in the form a roller 47. Alternatively, it may be designed in the form of a wrapping paper guide 47 or it may function also as a wrapping paper feeding means.

With respect to the wrapping paper guiding section the wrapping paper guide wall adapted to move away from the paper surface of the wrapping paper may be located either downstream of the cutting knife (as in the first to fourth embodiments) or upstream of the same (as in the fifth embodiment). Alternatively, it may be located both downstream and upstream of the cutting knife With respect to the wrapping paper feeding means the wrapping rollers may continue to rotate during a cycle of packaging operations in case of a combination of wrapping rollers and a stacked structure of coins. Particularly, in case of the first embodiment the arrangement is made such that the leading end part of the wrapping paper is brought just in light contact with the wrapping roller 18 while the latter is rotating and the wrapping paper retaining roller 47 serves to maintain the above light contact merely under the retaining force imparted by it. The wrapping paper retaining roller 47 is designed in the form of a freely rotatable roller but there is no fear of allowing the wrapping paper to move forward, because the leading end part of the wrapping paper is brought merely in fine contact with the wrapping roller 18. Thus, all the wrapping rollers 17, 18 and 19 may continue to rotate during a cycle of packaging operations. It should be added that it will be preferable that the wrapping rollers are caused to stop their rotation when a stacked structure of coins is introduced into the working space defined by them as well as when a wrapped structure of coins is discharged downward therefrom as in the abovedescribed embodiments from a viewpoint of preventing an occurrence of breakdown of the stacked structure of coins and tearing of the wrapping paper.

As described above, the wrapping paper feeding device in accordance with the present invention is constructed such that the wrapping paper guide wall in the wrapping paper guide passage through which the wrapping paper is delivered from a wrapping paper roll to the packaging section constitutes a guide wall surface along which the wrapping paper is guided in the optimum manner until the leading end part thereof reaches the packaging section, a part of or the whole of the wrapping paper guide wall is displaced away from the wrapping paper guide passage when a length of wrapping paper required for packaging the stacked structure of coins is dimensioned longer than the length of the guide wall so that an additional feeding is ensured by way of free loosening of the wrapping paper effected by means of the wrapping paper feeding rollers, and a specific length of wrapping paper required for packaging the stacked structure of coins is forwarded by way of the steps of bringing the leading end part of the wrapping paper to the peripheral surface of the stacked structure of coins in the packaging section with the aid of a feeding means while causing the wrapping paper to be stretched and cutting off it by thrusting it against the cutting edges of the cutting knife in the stretched state. Thus, there is no necessity for elongating or shortening the wrapping paper guide passage in dependence on the length of the wrapping paper required for packaging coins having a different diameter. As a result it becomes possible to shorten the distance between the coin packaging section and the wrapping paper feeding rollers and design a coin packaging machine in substantially reduced dimensions. Further, there does not occur any inconvenience of injuring smooth displacement of the wrapping paper guide wall because of no necessity for changing the position of the latter as is the case with the conventional device. It is very easy to meet the requirement for any length of wrapping paper merely by controlling an extent of additional feeding by means of the wrapping paper feeding rollers when the required length of the wrapping paper is to be changed corresponding to the selected kind of coins to be packaged. What is claimed is:

1. A method of feeding wrapping paper, drawn from a roll of wrapping paper, to a packaging section in a coin packaging machine, the packaging section including a plurality of wrapping rollers, cutting a strip of the wrapping paper in accordance with the diameter of coins selected for packaging to provide a length of the wrapping paper sufficient to assure packaging of the selected coins, and packaging the selected coins, said method comprising the steps of:

(a) activating feed rollers to feed the leading edge of the wrapping paper past a cutting knife and past a guide passage which comprises a movable guide wall along which the paper slides to the packaging section;

(b) retaining the wrapping paper in a predetermined position along the guide passage;

(c) displacing the movable guide wall from a guide position to a second position to elongate the guide passage for the web while activating the feed rollers to feed an additional amount of the wrapping paper in accordance with the diameter of the selected coins to provide the sufficient length of the wrapping paper; and subsequently (d) holding the leading edge of the wrapping paper firmly between the outer cylindrical surface of a stack of the selected coins and the wrapping rollers; and (e) activating the wrapping rollers to wrap the wrapping paper about the stack of the selected coins, pulling the wrapping paper against the cutting knife to cut off the sufficient length of the wrapping paper, thereby packaging the selected coins.

2. A method as claimed in claim 1 in which the movable wrapping paper guide means is displaced from the guide position by pivoting said guide means about an upright shaft in an amount in accordance with the diameter of the selected coins.

3. A method as claimed in claim 1 in which the leading edge of the wrapping paper is firmly held by moving the wrapping rollers from an inoperative position to an operative position in which the leading edge is held in contact with the outer cylindrical surface of the stack of coins.

4. A method of feeding wrapping paper, drawn from a roll of wrapping paper, to a packaging section in a coin packaging machine, the packaging section including a plurality of wrapping rollers, cutting a strip of the wrapping paper in accordance with the diameter of coins selected for packaging to provide a length of the wrapping paper sufficient to assure packaging of the selected coins, and packaging the selected coins, said method comprising the steps of:

(a) activating feed rollers to feed the laading edge of the wrapping paper past a cutting knife and past a guide passage which comprises a movable guide wall along which the paper slides to a preparing section for feeding therefrom to the packaging section;

(b) retaining the leading edge of the wrapping paper at the preparing section;

(c) displacing the movable guide wall from a, guide position to a second position to elongate the guide passage for the web while activating the feed rollers to feed an additional amount of the wrapping paper in accordance with the diameter of the selected coins to provide the sufficient length of the wrapping paper;

(d) activating feeding means to feed the leading edge of the wrapping paper from the preparing section to the packaging section; and subsequently (e) holding the leading edge of the wrapping paper firmly between the outer cylindrical surface of a stack of the selected coins and the wrapping rollers; and (f) activating the wrapping rollers to wrap the wrapping paper about the stack of the selected coins, pulling the wrapping paper against the cutting knife to cut off the sufficient length of the wrapping paper, thereby packaging the selected coins.

5. A method as claimed in claim 4 in which the movable wrapping paper guide means is displaced from the guide position by pivoting said guide means about an upright shaft in an amount in accordance with the diameter of the selected coins.

6. A method as claimed in claim 4 in which the leading edge of the wrapping paper is firmly held by moving the wrapping rollers from an inoperative position to an operative position in which the leading edge is held in contact with the outer cylindrical surface of the stack of coins.

7. A device for feeding a specific length of wrapping paper, drawn from a roll of wrapping paper, to a packaging section in a coin packaging machine in accordance with the diameter of coins selected for packaging, said device comprising:

(a) wrapping paper feed rollers adapted to draw a strip of wrapping paper from a roll of wrapping paper toward a coin packaging section;

(b) means defining a wrapping paper guide passage extending between the wrapping paper feed rollers and the coin packaging section, said defining means including a guide wall at least a part of which comprises a movable wrapping paper guide wall along which paper slides, means to displace said movable guide wall from a guide position to a second position to elongate the guide passage for the web to cause an additional feeding of the wrapping paper to provide the specific length of the wrapping paper for packaging the selected coins;

(c) a plurality of wrapping rollers disposed at the coin packaging section for wrapping the specific length of wrapping paper about a stack of the selected coins;

(d) a cutting knife disposed along the wrapping paper guide passage for cutting off the specific length of the wrapping paper;

(e) a wrapping paper retaining mechanism adapted to be displaced from an inoperative position to an operative position for firmly holding the wrapping paper in a predetermined position along the wrapping paper guide passage;

(f) operation control means for controlling operation of the wrapping paper feed rollers, the movable wrapping paper guide means, the wrapping rollers, and the wrapping paper retaining mechanism in accordance with a predetermined sequence including driving the wrapping paper feed rollers to bring the leading edge of the wrapping paper to the coin packaging section, stopping the wrapping paper feed rollers, displacing the movable wrapping paper guide means from the guide position to the second position while operating the wrapping paper retaining mechanism to retain a predetermined portion of the wrapping paper, thereafter driving the wrapping paper feed rollers to feed additional wrapping paper to provide a length thereof corresponding to the diameter of the selected coins, driving the wrapping rollers while the wrapping paper is held between the wrapping rollers and the outer peripheral surface of the stack of the selected coins to pull the wrapping paper against the cutting knife, cutting off the specific length thereof, and to wrap the wrapping paper about the stacked coins.

8. A device as claimed in claim 7 in which the wrapping paper retaining mechanism comprises a wrapping paper retaining roller disposed along the wrapping paper guide passage, a link mechanism supporting said retaining roller, and a cam for operating said link roller.

9. A device as claimed in claim 7 in which the wrapper paper feed rollers comprise a driving roller and a driven roller.

10. A device as claimed in claim 7 in which the cutting knife has a V-shaped cutting edge to cut off the specific length with a V-shaped configuration.

11. A device as claimed in claim 7 in which the cutting knife includes a cutting edge, a leaf spring, and a cut-off detecting member secured to said leaf spring, said leaf spring being located between said cutting edge and said guide wall to urge the newly cut leading edge of the wrapping paper toward said guide wall after cutting thereof, said cut-off detecting member detecting completion of the cutting and signalling such completion to the operation control means.

12. A device as claimed in claim 7 further comprising means defining a plurality of wrapping paper storing sections, each associated with selected coins of a particular type and each including a pivotal shaft, a movable frame adapted to be turned by said pivotal shaft, and removable holding means extending radially from said pivotal shaft to hold wrapping paper of a width for wrapping the associated selected coins; and in which said wrapping paper guide passage comprises means defining first and second passages, the first passage being disposed on the movable frame for guiding a strip of the wrapping paper drawn from the roll of wrapping paper, the second passage being disposed as a continuation of the first passage and extending to the coin packaging station, the movable wrapping paper guide means constituting at least a part of the second passage.

13. A device as claimed in claim 7 further comprising means defining a plurality of wrapping paper storing sections, each associated with selected coins of a particular type and each including a pivotal shaft, a movable frame adapted to be turned by said pivotal shaft, and removable holding means extending radially from said pivotal shaft to hold wrapping paper of a width for wrapping the associated selected coins; and in which said wrapping paper guide passage comprises means defining first and second passages, the first passage forming the movable wrapping paper guide means, the cutting knife being fixedly secured to the movable wrapping paper guide means to be movable therewith, the movable wrapping paper guide means being adapted to be displaced with the cutting knife from an initial location to a second location to cause additional feeding of the wrapping paper in accordance with the diameter of the selected coins, the second passage being disposed as a continuation of the movable wrapping paper guide means.

14. A device as claimed in claim 7 in which one of the wrapping paper feed rollers is adapted to be displaced from its operative position to a second position to draw back any residual length of wrapping paper to permit exchanging of the roll of wrapping paper for another roll of wrapping paper of another width.

15. A device for feeding a specific length of wrapping paper, drawn from a roll of wrapping paper, to a packaging station in a coin packaging machine in accordance with the diameter of coins selected for packaging, said device comprising:

(a) wrapping paper feed rollers adapted to draw a strip of wrapping paper from a roll of wrapping paper toward a preparing section;

(b) means defining a coin packaging section including a plurality of wrapping rollers for wrapping the specific length of wrapping paper about a stack of the selected coins;

(c) means defining a wrapping paper guide passage extending between the wrapping paper feed rollers and the preparing section, said defining means including a guide wall along which the wrapping paper slides, at least a part of the guide wall comprising a movable wrapping paper guide wall, means to displace said movable guide wall from a guide position to a second position to elongate the guide passage for the web to cause an additional feeding of the wrapping paper to provide the specific length of the wrapping paper for packaging the selected coins;

(d) a cutting knife disposed along the wrapping paper guide passage for cutting off the specific length of the wrapping paper;

(e) a wrapping paper retaining mechanism located at the preparing section and adapted to be displaced from an inoperative position to an operative position for firmly holding the wrapping paper adjacent the coin packaging section, said wrapper paper retaining mechanism including feeding means for feeding the wrapping paper from the preparing section to the packaging section;

(f) operation control means for controlling operation of the wrapping paper feed rollers, the movable wrapping paper guide means, the wrapping rollers, and the wrapping paper retaining mechanism in accordance with a predetermined sequence including driving the wrapping paper feed rollers to bring the leading edge of the wrapping paper to the coin preparing section, stopping the wrapping paper feed rollers, displacing the movable wrapping paper guide means from the guide position to the second position while operating the wrapping paper retaining mechanism to retain the leading edge of the wrapping paper at the preparing section, thereafter driving the wrapping paper feed rollers to feed additional wrapping paper to provide a length thereof corresponding to the diameter of the selected coins, driving the feeding means of the wrapping paper retaining mechanism and the wrapping rollers to feed the wrapping paper from the separating section to the packaging section while pulling the wrapping paper against the cutting knife, cutting off the specific length thereof, and to wrap the the wrapping paper about the stacked coins.

16. A device as claimed in claim 15 in which the wrapping paper retaining mechanism comprises a wrapping paper retaining roller disposed adjacent one end of the wrapping paper guide passage and cooperating with a stationary one of the wrapping rollers to firmly hold the leading edge of the wrapping paper, said wrapping paper retaining roller being adapted to be displaced from the inoperative position to the operative position in which it contacts said stationary one of the wrapping rollers.

17. A device as claimed in claim 15 in which the wrapping paper retaining mechanism comprises a pair of wrapping paper retaining rollers disposed adjacent the end of the wrapping paper guide passage, one wrapping paper retaining roller being stationary and the other wrapping paper retaining roller being adapted to be displaced from the inoperative position to the operative position in which it contacts the stationary wrapping paper retaining roller.

18. A device as claimed in claim 15 in which one of the wrapping paper feed rollers is adapted to be displaced from its operative position to a second position to draw back any residual length of wrapping paper to permit exchanging of the roll of wrapping paper for another roll of wrapping paper of another width.

* * * * *